US011415329B2

(12) United States Patent
Liu et al.

(10) Patent No.: US 11,415,329 B2
(45) Date of Patent: Aug. 16, 2022

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Yu Liu, Foshan (CN); Kangwen Zhang, Foshan (CN); Hui Yu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 335 days.

(21) Appl. No.: 16/497,927

(22) PCT Filed: Jan. 31, 2019

(86) PCT No.: PCT/CN2019/074105
§ 371 (c)(1),
(2) Date: Sep. 26, 2019

(87) PCT Pub. No.: WO2020/037956
PCT Pub. Date: Feb. 27, 2020

(65) Prior Publication Data

US 2021/0332987 A1 Oct. 28, 2021

(30) Foreign Application Priority Data

Aug. 21, 2018 (CN) ..... 201810956185.1
Aug. 21, 2018 (CN) ..... 201810956881.2
(Continued)

(51) Int. Cl.
*F24F 1/027* (2019.01)
*F24F 1/031* (2019.01)

(52) U.S. Cl.
CPC ..... *F24F 1/027* (2013.01); *F24F 1/031* (2019.02)

(58) Field of Classification Search
CPC ... F24F 1/027; F24F 1/031; F16B 2/04; F16B 2/185; Y10T 403/595; Y10T 403/602
See application file for complete search history.

(56) References Cited

U.S. PATENT DOCUMENTS 5,253,485 A * 10/1993 Kennedy ..... F24F 1/027 454/201
6,192,809 B1 * 2/2001 Riach ..... A47B 3/087 108/115
(Continued)

FOREIGN PATENT DOCUMENTS

CA 3057095 A1 2/2020
CN 2444166 Y 8/2001
(Continued)

OTHER PUBLICATIONS

Storm, 12V / 24V Magnetic Door Lock 1200lbs—with brackets, DE-ML1200-08KT, Jun. 2014, Rev 2, https://www.storm-interface.com/pub/media/productattachments/files/File-1480538331.pdf (Year: 2014).*
(Continued)

*Primary Examiner* — Larry L Furdge
*Assistant Examiner* — Chang H Park
(74) *Attorney, Agent, or Firm* — Anova Law Group PLLC

(57) ABSTRACT

A window air conditioner includes a casing and a positioning device. The casing includes a cabinet including an outdoor part and an indoor part spaced apart from each other to form a receiving groove. The positioning device has a
(Continued)

locked state and an unlocked state, and is configured to extend further into the receiving groove in the locked state than in the unlocked state.

17 Claims, 34 Drawing Sheets

(30) Foreign Application Priority Data

| | | |
|---|---|---|
| Aug. 21, 2018 | (CN) | 201821354639.X |
| Aug. 21, 2018 | (CN) | 201821354663.3 |
| Aug. 21, 2018 | (CN) | 201821354697.2 |

(56) References Cited

U.S. PATENT DOCUMENTS

| | | | | |
|---|---|---|---|---|
| 7,121,105 | B1 * | 10/2006 | Rais | F24F 1/0003 62/262 |
| 8,104,800 | B2 * | 1/2012 | Lorek | E05B 65/0042 292/108 |
| 8,516,660 | B2 * | 8/2013 | Ku | B65D 63/1072 24/16 PB |
| 2017/0191679 | A1 | 7/2017 | Xu et al. | |
| 2020/0248911 | A1 | 8/2020 | Lei et al. | |

FOREIGN PATENT DOCUMENTS

| | | | |
|---|---|---|---|
| CN | 2622607 | Y | 6/2004 |
| CN | 102455025 | A | 5/2012 |
| CN | 105465905 | A | 4/2016 |
| CN | 105485786 | A | 4/2016 |
| CN | 205618492 | U | 10/2016 |
| CN | 106969481 | A | 7/2017 |
| CN | 107289602 | A | 10/2017 |
| CN | 206648183 | U | 11/2017 |
| CN | 206648197 | U | 11/2017 |
| CN | 206959272 | U | 2/2018 |
| CN | 207132495 | U | 3/2018 |
| CN | 107940724 | A | 4/2018 |
| CN | 207471698 | U | 6/2018 |
| CN | 108870565 | A | 11/2018 |
| CN | 109184456 | A | 1/2019 |
| CN | 208671189 | U | 3/2019 |
| CN | 208671286 | U | 3/2019 |
| CN | 109724163 | A | 5/2019 |
| CN | 109724167 | A | 5/2019 |
| CN | 109724168 | A | 5/2019 |
| CN | 109724169 | A | 5/2019 |
| CN | 109724170 | A | 5/2019 |
| CN | 109724171 | A | 5/2019 |
| CN | 109724172 | A | 5/2019 |
| CN | 208920420 | U | 5/2019 |
| CN | 109959079 | A | 7/2019 |
| CN | 109974128 | A | 7/2019 |
| EP | 3228948 | A1 | 10/2017 |
| JP | S5816135 | A | 1/1983 |
| JP | S611935 | A | 1/1986 |
| WO | 2020037956 | A1 | 2/2020 |
| WO | 2020038239 | A1 | 2/2020 |
| WO | 2020155353 | A1 | 8/2020 |
| WO | 2020155625 | A1 | 8/2020 |

OTHER PUBLICATIONS

Grassfire, Door magnetic lock, Sep. 15, 2016, Grassfire.org, https://grassfire.org/magnetic-door-locks/door-magnetic-lock/ (Year: 2016).*

Bricklink, Hinge Brick 1×2 Complete Assembly, Jul. 19, 2016, https://www.bricklink.com/v2/catalog/catalogitem.page?P=3937c01#T=C (Year: 2016).*

The State Intellectual Property Office of PRC (SIPO) The Second Office Action for CN Application No. 201810956881.2 dated Jun. 12, 2020 15 Pages (Translation Included ).

The State Intellectual Property Office of PRC (SIPO) The First Office Action for CN Application No. 201810956185.1 dated Apr. 2, 2020 14 Pages (Translation Included ).

The State Intellectual Property Office of PRC (SIPO) The Second Office Action for CN Application No. 201810956185.1 dated Nov. 11, 2020 24 Pages (Translation Included ).

World Intellectual Property Organization (WIPO) International Search Report for PCT/CN2019/074105 dated May 17, 2019 20 Pages(Translation Included ).

World Intellectual Property Organization (WIPO) International Search Report for PCT/CN2019/099848 dated Nov. 1, 2019 24 Pages(Translation Included ).

The State Intellectual Property Office of PRC (SIPO) The First Office Action for CN Application No. 201810956881.2, dated Sep. 23, 2019 17 Pages (Translation Included ).

Canadian Intellectual Property Office The Office Action for CA Application No. 3057095 dated Feb. 2, 2021 5 Pages.

The State Intellectual Property Office of PRC (SIPO) The First Office Action for CN Application No. 202010605975.2, dated Mar. 18, 2021 13 Pages (Translation Included ).

World Intellectual Property Organization (WIPO) Written Opinion for PCT/CN2019/074105 dated May 17, 2019 10 Pages(Translation Included ).

World Intellectual Property Organization (WIPO) Written Opinion for PCT/CN2019/099848 dated Nov. 1, 2019 10 Pages(Translation Included ).

Canadian Intellectual Property Office The Office Action for CA Application No. 3065409 dated Feb. 26, 2021 5 Pages.

Canadian Intellectual Property Office The Office Action for CA Application No. 3057119 dated Jan. 28, 2021 5 Pages.

* cited by examiner

F–F

G-G

WINDOW AIR CONDITIONER

CROSS-REFERENCE TO RELATED APPLICATIONS

This application is a National Stage Entry under 35 U.S.C. § 371 of International Application No. PCT/CN2019/074105, filed on Jan. 31, 2019, which is based on and claims priority to Chinese Patent Application Nos. 201821354697.2, 201810956185.1, 201821354663.3, 201810956881.2 and 201821354639.X, filed on Aug. 21, 2018, the entire contents of all of which are incorporated herein by reference

FIELD

The present disclosure relates to a field of air conditioners, and more particularly to a window air conditioner.

BACKGROUND

In the related art, most window air conditioners do not have a structure to fix a window, such that many components are needed to fix the window after the window air conditioner is mounted, and thus mounting and dismounting processes of the window conditioner are complex, thereby affecting comfort of using the window air conditioner for a user.

SUMMARY

The present disclosure seeks to solve at least one of the technical problems existing in the related art. Hence, one objective of the present disclosure is to propose a window air conditioner, which can fix a window effectively, and simplify mounting and dismounting processes. Thus, it is convenient for a user to mount and dismount a window air conditioner, so as to improve the comfort for the user.

According to embodiments of the present disclosure, the window air conditioner is mounted at a mounting opening in a wall. A movable window is provided at the mounting opening. The window air conditioner includes a casing and a positioning device. The casing includes a cabinet. The cabinet includes an outdoor part and an indoor part, the outdoor part and the indoor part are spaced apart from each other to form a receiving groove, and the window is configured to be arranged in the receiving groove. The positioning device has a locked state and an unlocked state. In the locked state, the positioning device extends into the receiving groove and is fitted with the window to position the window. In the unlocked state, the positioning device is separated from the window.

In the window air conditioner according to embodiments of the present disclosure, by arranging the positioning device to position the window or be separated from the window, the window can be effectively fixed, and the mounting and dismounting processes of the window air conditioner are simplified. Thus, it is convenient for the user to mount or dismount the air window conditioner, thereby improving the comfort for the user.

According to some embodiments of the present disclosure, the positioning device is arranged at a side wall of the indoor part close to the outdoor part.

In some embodiments of the present disclosure, the positioning device includes: a positioning member, one end of the positioning member being arranged at the indoor part, the other end of the positioning member extending towards the receiving groove with respect to the indoor part, and the other end of the positioning member being movable with respect to the indoor part; a first elastic member, an end of the first elastic member being fitted with the positioning member to normally push the other end of the positioning member to move into the receiving groove to the locked state.

Furthermore, the positioning device also includes a mounting shaft, an abutting protrusion and a connecting plate. The mounting shaft is arranged at the indoor part. The abutting protrusion is arranged at an end of the mounting shaft facing towards the receiving groove. The connecting plate is connected with the positioning member, and the connecting plate is sleeved over the mounting shaft. The connecting plate is movable with respect to the mounting shaft. The first elastic member is sleeved over the mounting shaft, and the first elastic member abuts against the connecting plate.

According to other embodiments of the present disclosure, the positioning device includes: a rotating member, one end of the rotating member being rotatably arranged at the indoor part, the rotating member provided with a sliding slot extending along its length direction; a rotating drive member rotatably arranged at the indoor part through a pivot shaft, the rotating drive member being provided with a drive shaft which extends into the sliding slot and is movably fitted with the sliding slot, the drive shaft being spaced apart from the pivot shaft, the rotating drive member being configured to rotate to drive the other end of the rotating member to rotate between the locked state and the unlocked state through the drive shaft.

Furthermore, the rotating drive member includes a cam rotatably arranged at the indoor part by the pivot shaft, and the drive shaft is arranged at the cam.

According to some more embodiments of the present disclosure, the positioning device includes: a cover, one end of the cover being rotatably arranged at the indoor part, the cover being provided with a first magnetic member; a second magnetic member arranged at the indoor part, wherein when the second magnetic member is in a power-off state, the second magnetic member is nonmagnetic, and when the second magnetic member is in a power-on state, the second magnetic member and the first magnetic member are attracted with each other to control the cover to rotate to the unlocked state; a second elastic member, an end of the second elastic member abutting against the cover to normally push the cover to rotate to the locked state.

Furthermore, the positioning device further includes: a battery box arranged in the indoor part and electrically connected with the second magnetic member; a switch arranged at an outer side wall of the indoor part, the switch being electrically connected with the battery box to control the power on and the power off of the second magnetic member.

According to some embodiments of the present disclosure, the casing further includes a chassis, the chassis is disposed at a bottom of the cabinet and arranged at the wall, and the window air conditioner further comprises a sealing device. The sealing device includes: a fixing member connected with the casing; a sliding member slidably fitted with the fixing member, the sliding member having a first position and a second position. In the first position, the sliding member overlaps the fixing member. In the second position, the sliding member slides and extends out of the fixing member and contacts with the mounting opening, and the fixing member and the sliding member contact with the window, respectively, so as to seal a gap between the window and the mounting opening.

According to some embodiments of the present disclosure, one of the fixing member and the sliding member is provided with a positioning part, and the other one of the fixing member and the sliding member is provided with a sliding guide rail fitted with the positioning part. The positioning part has a deformed state and a positioned state, and the sliding guide rail has a plurality of positioning grooves spaced apart from one another along a length direction of the sliding guide rail. In the positioned state, at least a part of the positioning part extends into the positioning groove to only restrict a degree of freedom of movement of the sliding member in a direction approaching the fixing member, and in the deformed state, the positioning part is separated from the positioning groove.

According to some embodiments of the present disclosure, the positioning part has a first inclined surface and a second inclined surface, an included angle $\alpha$ between the first inclined surface and a reference plane is larger than 90 degrees, and an included angle $\beta$ between the second inclined surface and the reference plane is equal to 90 degrees. Each positioning groove has a third inclined surface and a fourth inclined surface, the third inclined surface is arranged parallel to the first inclined surface, and the fourth inclined surface is arranged parallel to the second inclined surface. When the sliding member moves in a direction running away from the fixing member, the first inclined surface and the third inclined surface are slidably fitted with each other. When the sliding member moves in the direction approaching the fixing member, the second inclined surface abuts against the fourth inclined surface to restrict a movement of the sliding member. The reference plane is a horizontal plane parallel to an extending direction of the sliding guide rail.

According to some embodiments of the present disclosure, one of the fixing member and the sliding member is provided with an assembling groove, the positioning part is arranged in the assembling groove, and the positioning part has elasticity.

According to some embodiments of the present disclosure, the sealing device is rotatable with respect to the casing, and the sealing device has a stretched state and a retracted state. In the retracted state, the sealing device is received in the receiving groove, and in the stretched state, the sealing device rotates and extends out of the casing.

According to some embodiments of the present disclosure, the sealing device is rotatable with respect to the casing, the chassis is provided with an accommodating groove, and the sealing device has a stretched state and a retracted state. In the retracted state, the sealing device is accommodated in the accommodating groove, and in the stretched state, the sealing device rotates and extends out of the casing.

In some embodiments of the present disclosure, the casing comprises a chassis, and the chassis is disposed at a bottom of the cabinet and arranged at the wall. The window air conditioner further includes a sealing device, a connecting end of the sealing device is rotatably connected with the casing, and the sealing device has a retracted state and a sealed state. In the retracted state, the sealing device is received in the casing, and in the sealed state, the sealing device extends out of the casing and contacts with a lower end of the window so as to seal a gap between the window and the mounting opening.

According to some embodiments of the present disclosure, the casing is provided with an engaging shaft, the connecting end of the sealing device is provided with a hook, the hook is hooked on the engaging shaft, and the sealing device is rotatable with respect to the engaging shaft.

According to some embodiments of the present disclosure, a bottom wall of the receiving groove is provided with an assembling slot recessed downwards, and the engaging shaft is arranged in the assembling slot.

According to some embodiments of the present disclosure, an outer peripheral wall of the chassis is provided with a recessed part, and the connecting end of the sealing device is provided with an assembling opening. In the sealed state, a part of the chassis extends into the assembling opening such that an outer peripheral wall of the recessed part is fitted with an inner peripheral wall of the assembling opening.

According to some embodiments of the present disclosure, the sealing device includes: a rotating part rotatably connected with the casing; a sealing part connected with the rotating part, and being stretchable and retractable with respect to the rotating part. In the retracted state, at least a part of the sealing part is received in the rotating part. In the sealed state, the sealing part extends out of the rotating part and is closely fitted with an inner wall of the mounting opening.

Additional aspects and advantages of embodiments of present disclosure will be given in part in the following descriptions, become apparent in part from the following descriptions, or be learned from the practice of the embodiments of the present disclosure.

Figure 1:
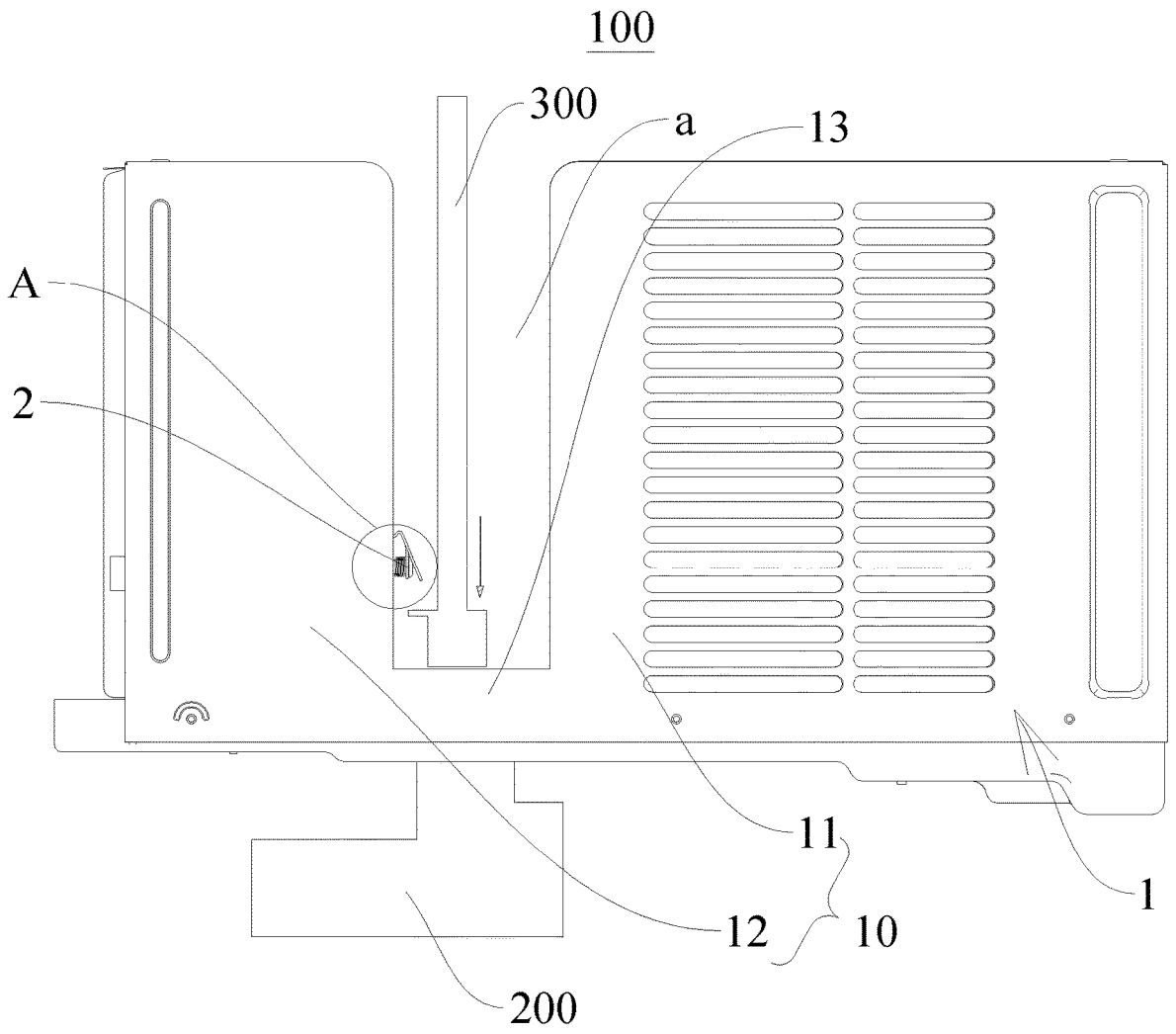
FIG. 1 is a front view of a window air conditioner according to some embodiments of the present disclosure.

REFERENCE NUMERALS window air conditioner 100;

casing 1; cabinet 10; outdoor part 11; indoor part 12; receiving groove a; accommodating groove b; engaging shaft 103; assembling slot c; chassis 13; recessed part 131;

positioning device 2;

positioning member 211; first elastic member 212; mounting shaft 213; connecting hole 213*a*; abutting protrusion 214; connecting plate 215; connector 216;

rotating member 221; sliding slot 221*a*; rotating drive member 222; pivot shaft 222*a*; drive shaft 222*b*; cam 222*c*; rotating knob 222*d*; rotating shaft 223;

cover 231; first magnetic member 232; second magnetic member 233; second elastic member 234; battery box 235; switch 236; position limiting structure 237; position limiting through hole 237*a*; mounting groove 237*b*; support bar 238;

wall 200; mounting opening 201; window 300; window frame 301;

sealing device 30;

fixing member 31; first positioning hole 311; positioning part 312; connecting arm 3121; assembling protrusion 3122; first inclined surface 3122*a*; second inclined surface 3122*b*; assembling groove 313; slide rail 314;

sliding member 32; second positioning hole 321; sliding guide rail 322; positioning groove 3221; third inclined surface 3221*a*; fourth inclined surface 3221*b*; sliding groove 323;

locking member 33;

connecting end 34; hook 341; assembling opening 3412;

sealing end 35;

rotating part 36;

sealing part 37; adhesive layer 371.

DETAILED DESCRIPTION

Embodiments of the present disclosure are further described with reference to the accompanying drawings. Same or similar reference signs represent the same or similar components or components that have the same or similar functions from beginning to end. The embodiments described below with reference to the accompanying drawings are exemplary, are merely used to explain the present disclosure, and cannot be construed as a limitation to the present disclosure.

In the specification of the present disclosure, it is to be understood that, terms such as "central," "length," "width," "thickness," "upper," "lower," "left," "right," "vertical," "horizontal," "top," "bottom," "inner," "outer," "axial" indicate the orientation or position relationship based on the orientation or position relationship illustrated in the drawings only for convenience of description or for simplifying description of the present disclosure, and do not alone indicate or imply that the device or element referred to must have a particular orientation or be constructed and operated in a specific orientation, and hence cannot be construed as a limitation to the present disclosure. Moreover, the feature associated with "first" and "second" may include one or more of this feature. In the description of the present disclosure, "a plurality of" means two or more than two, unless specified otherwise.

In the present disclosure, it should be noted, unless specified or limited otherwise, the terms "mounted," "connected," "coupled" or the like are used broadly. The terms may indicate, for example, fixed connections, detachable connections, or integral connections, may also indicate mechanical or electrical connections or mutual communication, may also indicate direct connections or indirect connections via intermediate mediums, and may also indicate inner communications of two elements or the interaction between two elements. The specific meanings of the terms in embodiments of the present disclosure may be understood by those skilled in the art according to particular circumstances.

A window air conditioner 100 according to embodiments of the present disclosure will described with reference to the drawings below. The window air conditioner 100 is mounted at a mounting opening 201 in a wall 200, and a movable window 300 is arranged at the mounting opening 201.

As illustrated in FIG. 1, the window air conditioner 100 according to embodiments of the present disclosure includes a casing 1 and a positioning device 2.

Specifically, the casing 1 includes a cabinet 10, and the cabinet 10 includes an outdoor part 11 and an indoor part 12. The outdoor part 11 and the indoor part 12 are spaced apart from each other to form a receiving groove a, and the window 300 is adapted to be placed in the receiving groove a. Thus, after the window air conditioner 100 is mounted, the indoor part 12 and the outdoor part 11 are separated by the window 300. After the window 300 is placed in the receiving groove a, the window 300 has a certain fixing effect on the window air conditioner 100, which can improve the stability of arranging the window air conditioner 100 at the mounting opening 201 to a certain degree. Further, it can be understood that, in a width direction of the mounting opening 201, the window 300 is extended from the receiving groove a to a side wall of the mounting opening 201, thus effectively enlarging a light transmission area of the window air conditioner 100, so as to improve a daylighting effect of the window 300, and also to beautify the window 300 to a certain degree for improving a user's comfort.

In addition, the window air conditioner 100 achieves cooling and heating effects with the outdoor part 11 and the indoor part 12 operating together. Thus, the casing 1 also includes a chassis 13, and the chassis 13 is adapted to be supported in the mounting opening 201, and is connected with the outdoor part 11 and the indoor part 12, respectively, so as to ensure that the indoor part 12 and the outdoor part 11 are communicated. Consequently, the reliability of the overall structure of the window air conditioner 100 can be ensured, and the normal operation of the window air conditioner 100 can be ensured.

The positioning device 2 has a locked state and an unlocked state. In the locked state, the positioning device 2 extends into the receiving groove a and is fitted with the window 300 to position the window 300. In the unlocked state, the positioning device 2 is separated from the window 300.

Thus, the user may control the positioning device 2 to be in the locked state so as to position the window 300 in the receiving groove a, without any other auxiliary parts such as a screw, which simplifies the process of positioning the window 300 after the user mounts the window air conditioner 100. The operation to position the window 300 by user is simple. Further, it is effectively avoided that the window 300 is destroyed by dismounting and mounting the window air conditioner 100, and also it helps to reduce the cost of mounting the window air conditioner 100.

The user may also control the positioning device 2 to be in the unlocked state so as to unlock the window 300 positioned in the receiving groove a, such that the window 300 is separated from the positioning device 2, and hence it is convenient to open the mounting opening 201. Thus, the user may enjoy fresh air or dismount the window air conditioner 100, and hence the way to detach the window air conditioner 100 from the window 300 is simple and easy to handle.

As mentioned above, after mounting the window air conditioner 100 according to embodiments of the present disclosure, the user may control the positioning device 2 to be in the locked state or the unlocked state so as to position or unlock the window 300 in the receiving groove a according to the actual needs. Thus, the window 300 can be effectively fixed, and it is convenient for the user to mount and dismount the window air conditioner 100. The mounting and dismounting processes of the window air conditioner 100 are effectively simplified, and the comfort for the user is improved. Moreover, the window 300 is effectively avoided from being destroyed by dismounting and mounting the window air conditioner 100.

In the window air conditioner 100 according to embodiments of the present disclosure, with the positioning device 2 positioning or being separated from the window 300, the window 300 can be effectively fixed, and the mounting and dismounting processes of the window air conditioner 100 are simplified, which facilitates the user to mount and dismount the window air conditioner 100 and improves the user's comfort.

As illustrated in FIGS. 1-5, according to some embodiments of the present disclosure, the positioning device 2 is arranged at a side wall of the indoor part 12 close to the outdoor part 11. Thus, the reliability of positioning the window 300 by the positioning device 2 can be ensured to a certain degree, and also an occupied space of the window air conditioner 100 can be reduced, thus ensuring the light transmission area of the window 300.

In some embodiments of the present disclosure, the positioning device 2 includes a positioning member 211 and a first elastic member 212.

One end of the positioning member 211 is arranged at the indoor part 12, and the other end of the positioning member 211 extends towards the receiving groove a with respect to the indoor part 12. The other end of the positioning member 211 is movable with respect to the indoor part 12. One end of the first elastic member 212 is fitted with the positioning member 211 to normally push the other end of the positioning member 211 to move into the receiving groove a to the locked state. Hence, the structure of the positioning device 2 is simple.

In the process of placing the window 300 in the receiving groove a, when the window 300 passes by the positioning member 211, the window 300 squeezes the positioning member 211 so that the positioning member 211 overcomes a push force of the first elastic member 212 and moves to the indoor part 12, so as to ensure that the window 300 extends into the receiving groove a. When the window 300 is placed, the positioning member 211 abuts against the window 300 under the push force of the first elastic member 212, so as to be in the locked state, thus positioning the window 300, so that the window 300 can be stably arranged in the receiving groove a.

When the user needs to move at least a part of the window 300 out of the receiving groove a, he/she only needs to press the positioning member 211 manually so that the positioning member 211 overcomes the push force of the first elastic member 212 and moves to the indoor part 12, so as to be in the unlocked state. Then, the positioning device 2 is separated from the window 300.

Figure 2:
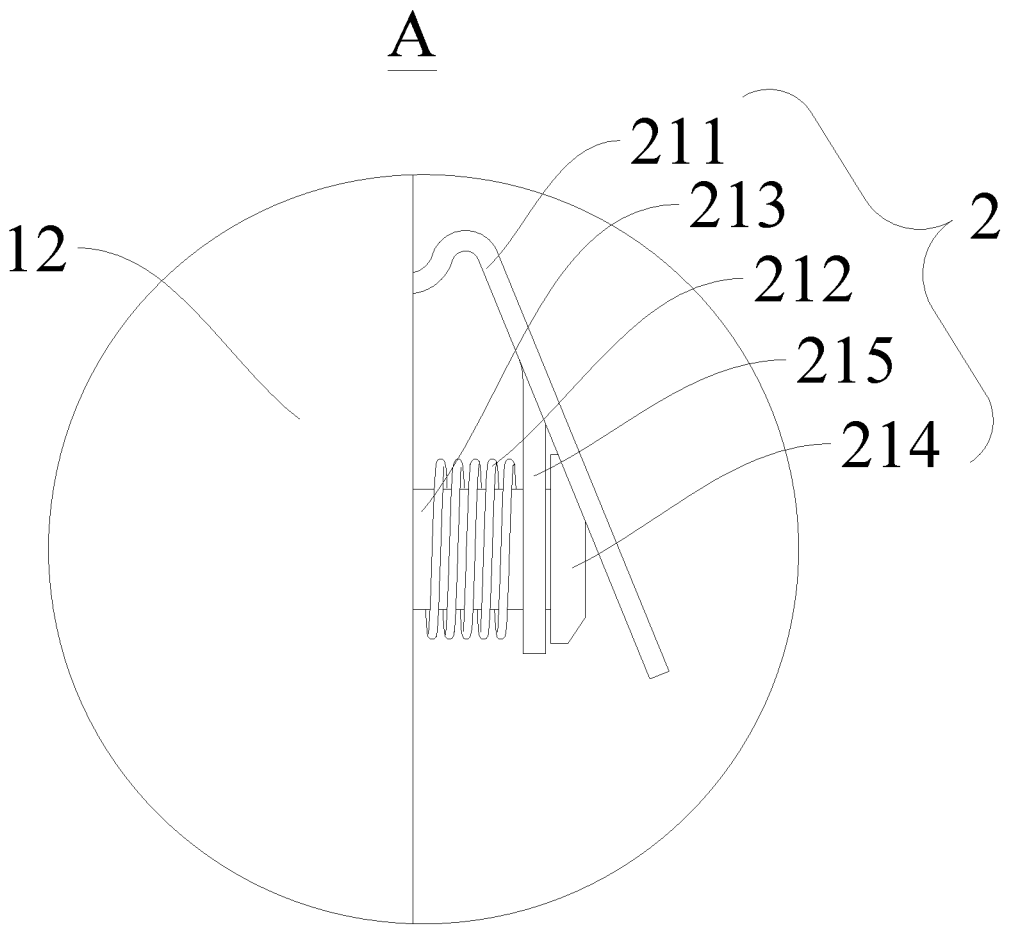
FIG. 2 is an enlarged view of a part Ain FIG. 1.
Figure 3:
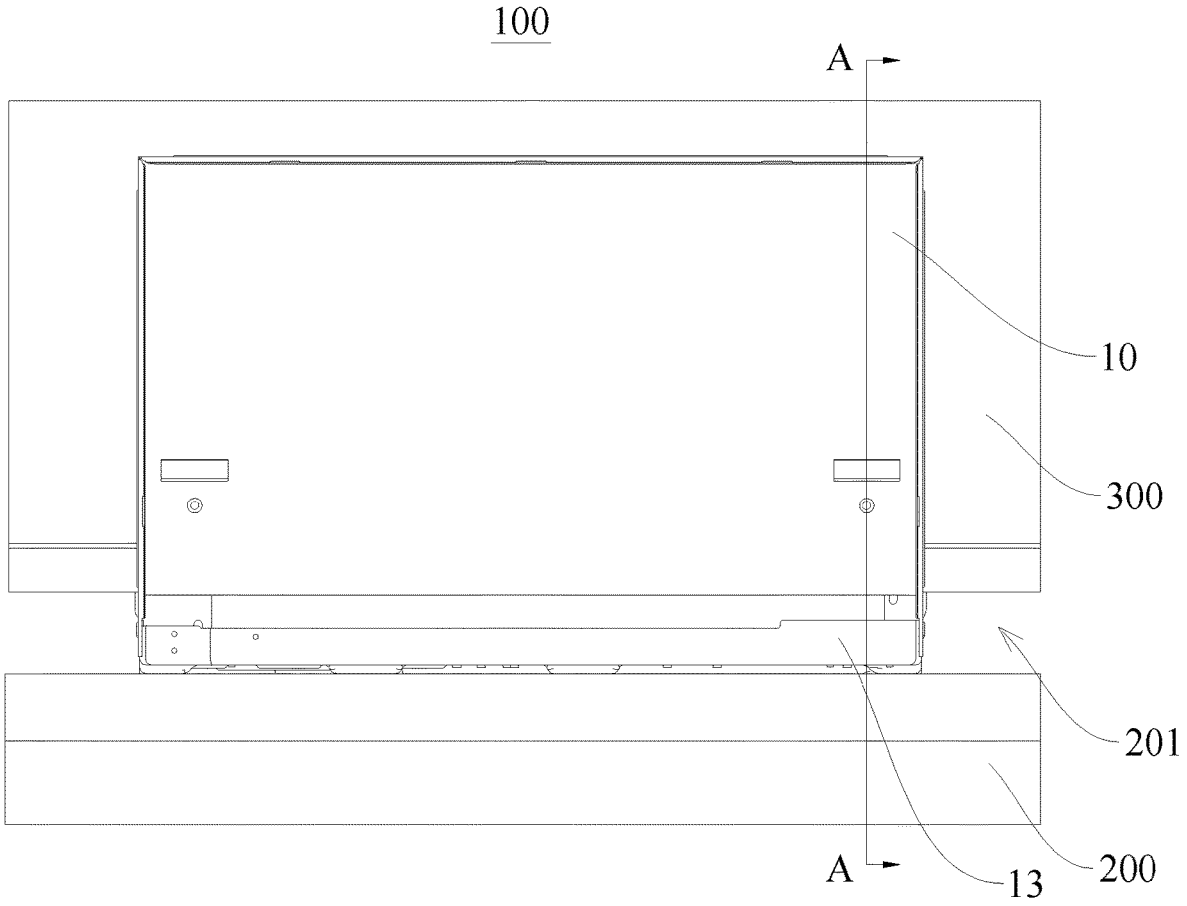
FIG. 3 is a left view of a window air conditioner according to some embodiments of the present disclosure.
Figure 4:
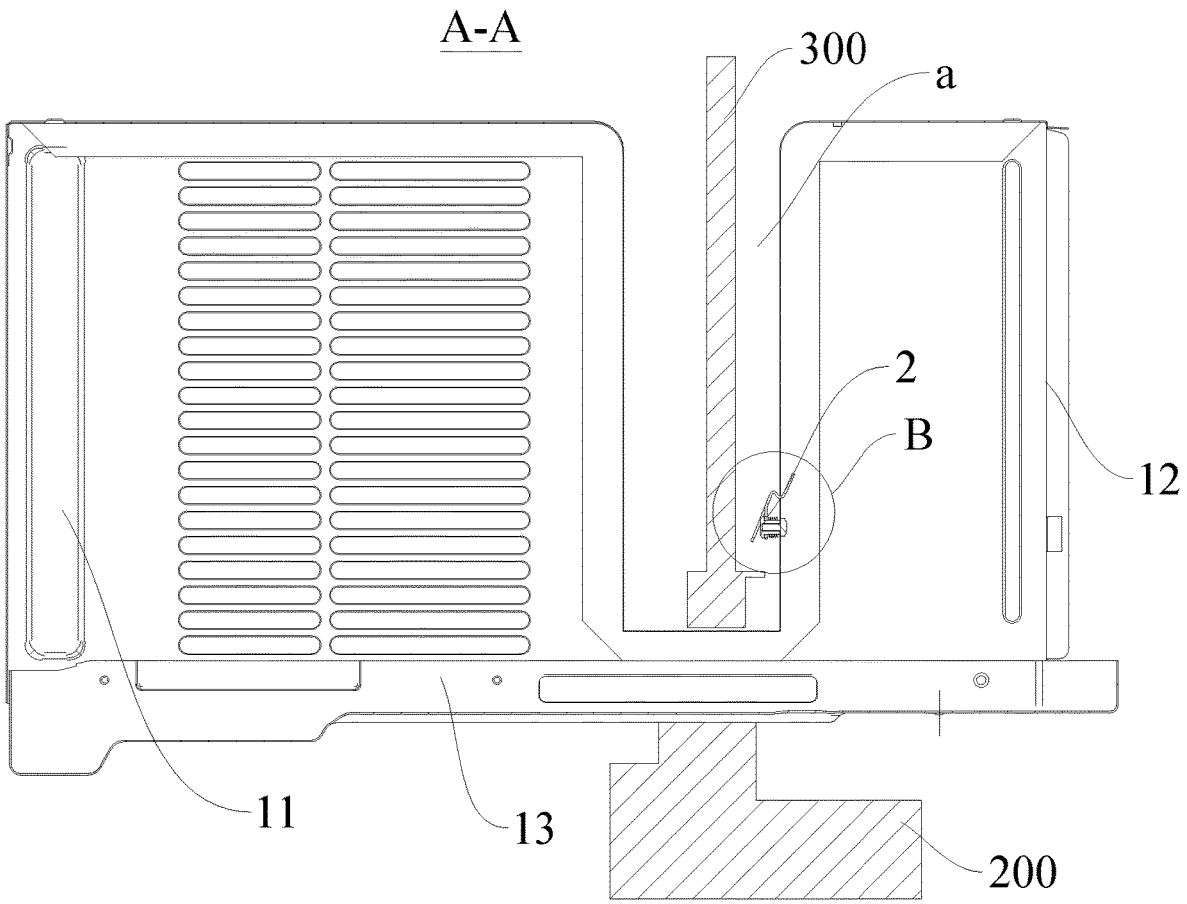
FIG. 4 is a sectional view along a line A-A in FIG. 3.
Figure 5:
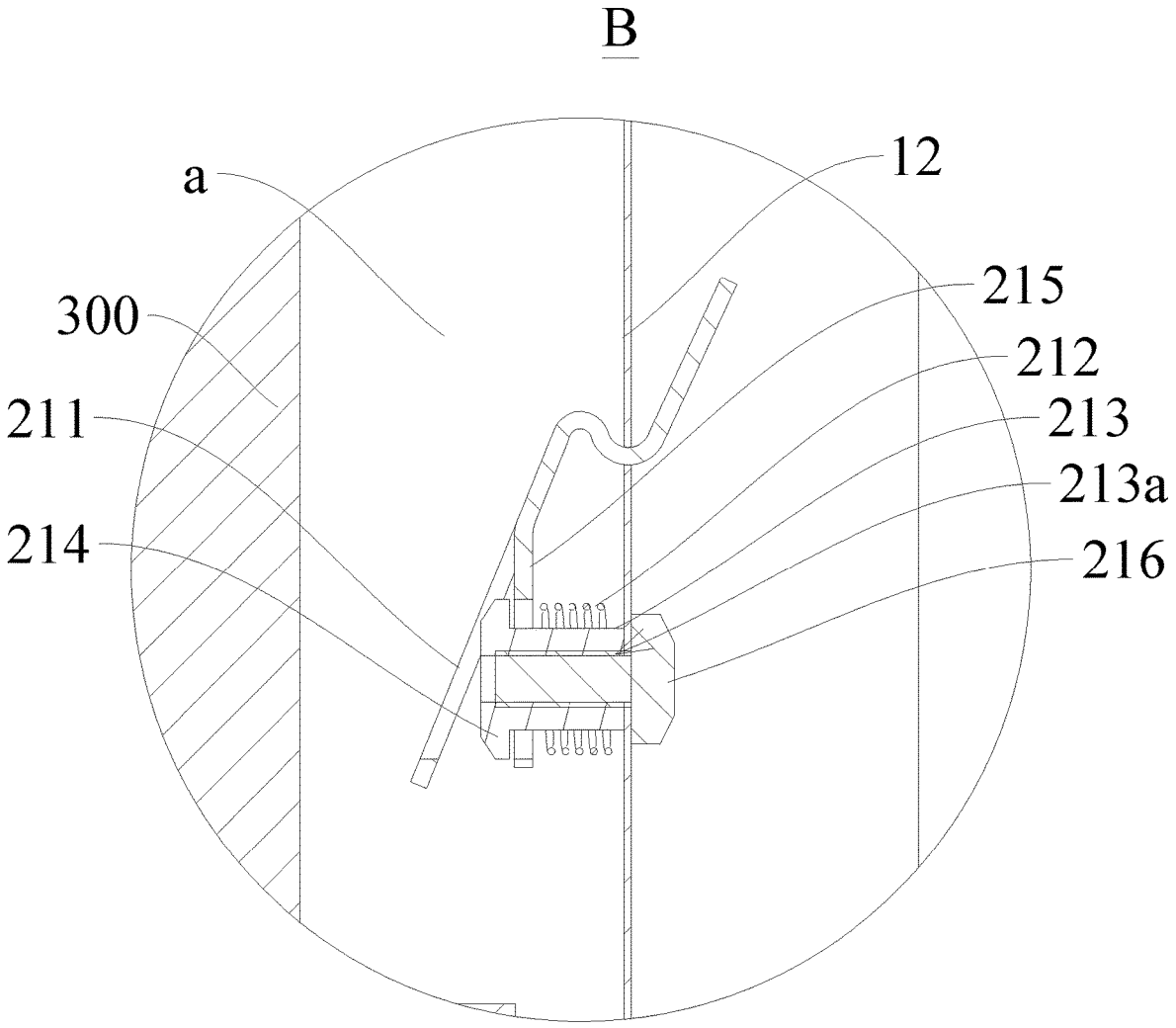
FIG. 5 is an enlarged view of a part B of FIG. 4.
Figure 6:
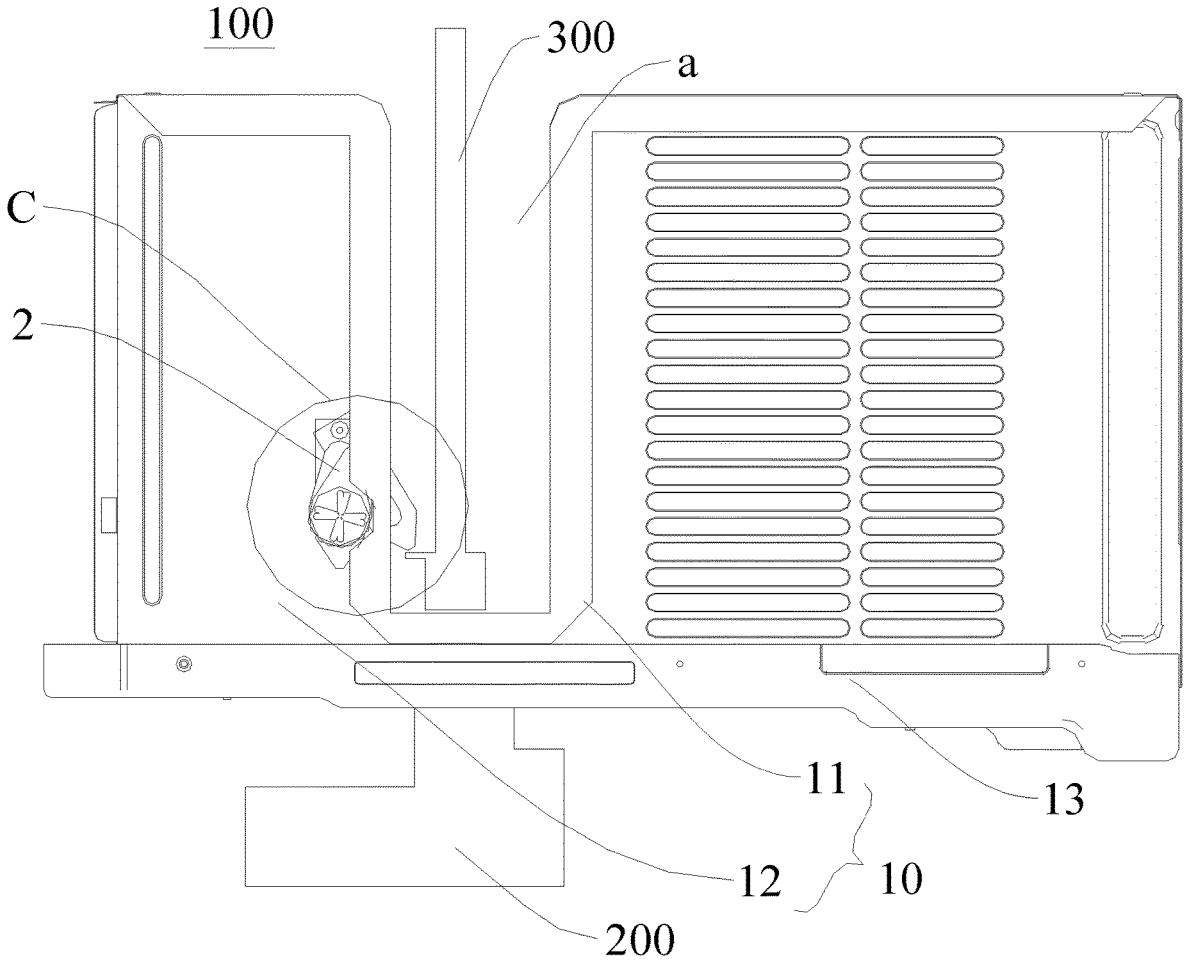
FIG. 6 is a front view of a window air conditioner according to some embodiments of the present disclosure.

Furthermore, as illustrated in FIG. 2 and FIG. 5, the positioning device 2 also includes a mounting shaft 213, an abutting protrusion 214 and a connecting plate 215. The mounting shaft 213 is arranged at the indoor part 12. The abutting protrusion 214 is arranged at an end of the mounting shaft 213 facing to the receiving groove a. The connecting plate 215 is connected with the positioning member 211, and sleeved over the mounting shaft 213. The connecting plate 215 is movable with respect to the mounting shaft 213. The first elastic member 212 is sleeved over the mounting shaft 213 and abuts against the connecting plate 215.

Thus, when the positioning member 211 is not subject to an external force, the connecting plate 215 moves along the mounting shaft 213 to the abutting protrusion 214 driven by the first elastic member 212. Since the connecting plate 215 is connected with the positioning member 211, the positioning plate 211 moves synchronously with the connecting plate 215 to the locked state. When the positioning device 2 is in the unlocked state, the positioning member 211 moves to the indoor part 12 under action of the external force, and thus the connecting plate 215 compresses the first elastic member 212. Therefore, the reliability of the first elastic member 212 normally drives the other end of the positioning member 211 to move into the receiving groove a to the locked state is ensured, and the structure of the positioning device 2 for positioning the window 300 is simple and reliable.

Specifically, the first elastic member 212 is a spring, which helps to reduce the manufacturing cost of the window air conditioner 100 and ensures the reliability of the first elastic member 212 pushing the positioning member 211 to move to the locked state. The first elastic member 212 may also be formed by other materials as long as the reliability of the positioning device 2 is ensured.

Further, as illustrated in FIG. 5, the positioning device 2 also includes a connector 216, and the connector 216 passes through the side wall of the indoor part 12 and is fitted with a connecting hole 213*a* in the mounting shaft 213 so as to fix the mounting shaft 213 to the indoor part 12. Thus, the reliability of the positioning device 2 being arranged at the indoor part 12 can be ensured, and also it is convenient for the user to mount and dismount the positioning device 2.

Specifically, the connector 216 is a screw and the connecting hole 213*a* is a threaded hole. Therefore, the cost of the connector 216 is low, and also the reliability of the fit of the connector 216 and the connecting hole 213*a* can be ensured, which facilitates mounting and dismounting of the positioning device 2.

Optionally, the connecting plate 215 is integral with the positioning member 211. Thus, the production efficiency of the window air conditioner 100 can be enhanced, and the structural strength and reliability of the positioning device 2 can be improved.

Specifically, as illustrated in FIG. 5, the one end of the positioning member 211 passes through the side wall of the indoor part 12 and extends into the indoor part 12. The two ends of the positioning member 211 are rotatable with respect to the indoor part 12. Hence, the reliability of the other end of the positioning member 211 located in the receiving groove a moving with respect to the indoor part 12 can be ensured.

Furthermore, the first elastic member 212 is arranged in the indoor part 12 and fitted with the one end of the positioning member 211 in the indoor part 12 for normally driving the other end of the positioning member 211 in the receiving groove a to rotate to the locked state. Thus, the reliability of the positioning device 2 can be ensured. Also, the structure of the positioning device 2 is simple and the cost is low.

Optionally, the positioning member 211 is a sheet-metal part. Thus, the strength of positioning member 211 can be ensured, and thus the reliability of positioning device 2 can be ensured.

Optionally, the positioning member 211 is integral with the casing 1. Thus, the production efficiency of the window air conditioner 100 can be improved.

As illustrated in FIGS. 6-11, according to some other embodiments of the present disclosure, the positioning device 2 includes a rotating member 221 and a rotating drive member 222.

One end of the rotating member 221 is rotatably arranged at the indoor part 12, and the rotating member 221 is provided with a sliding slot 221*a* extending along its length direction. The rotating drive member 222 is rotatably arranged at the indoor part 12 through a pivot shaft 222*a*. The rotating drive member 222 is provided with a drive shaft 222*b* which extends into the sliding slot 221*a* and is movably fitted with the sliding slot 221*a*. The drive shaft 222*b* is spaced apart from the pivot shaft 222*a*. The rotating drive member 222 rotates to drive the other end of the rotating member 221 to rotate between a locked state and an unlocked state through the drive shaft 222*b*. Thus, in the window air conditioner 100 according to embodiments of the present disclosure, the positioning device 2 switches between the locked state and the unlocked state through the rotating drive member 222 driving the rotating member 221 to rotate.

Thus, in the process of placing the window 300 in the receiving groove a, the rotating drive member 222 may be controlled to rotate so as to drive the other end of the rotating member 221 to rotate to the unlocked state through the drive shaft 222*b* sliding in the sliding slot 221*a*. Thus, a gap between the positioning device 2 and the window 300 is ensured such that the window 300 can be placed in the receiving groove a. After the window 300 is placed in position, the rotating drive member 222 may be controlled to rotate so as to drive the other end of the rotating member 221 to rotate to the locked state through the drive shaft 222*b* sliding in the sliding slot 221*a*, and then the other end of the rotating member 221 is fitted with the window 300 to position the window 300.

When the user needs to move at least a part of the window 300 out of the receiving groove a, he/she only needs to control the rotating drive member 222 to rotate so as to drive the other end of the rotating member 221 to rotate to the unlocked state through the drive shaft 222*b* sliding in the sliding slot 221*a*. Then, the positioning device 2 is separated from the window 300 and thus it is ensured that the at least part of the window 300 can be moved out of the receiving groove a.

Figure 7:
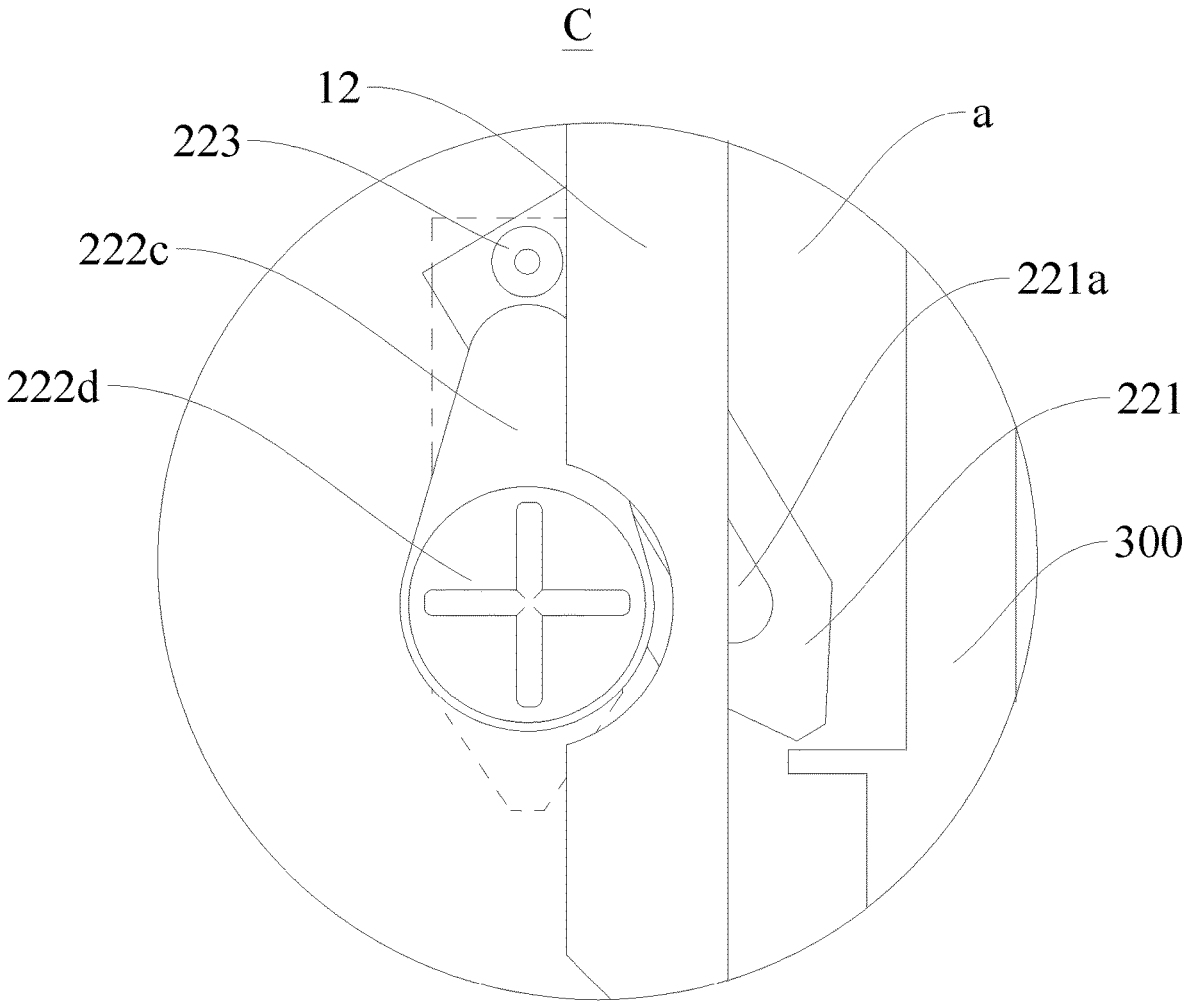
FIG. 7 is an enlarged view of a part C in FIG. 6.
Figure 8:
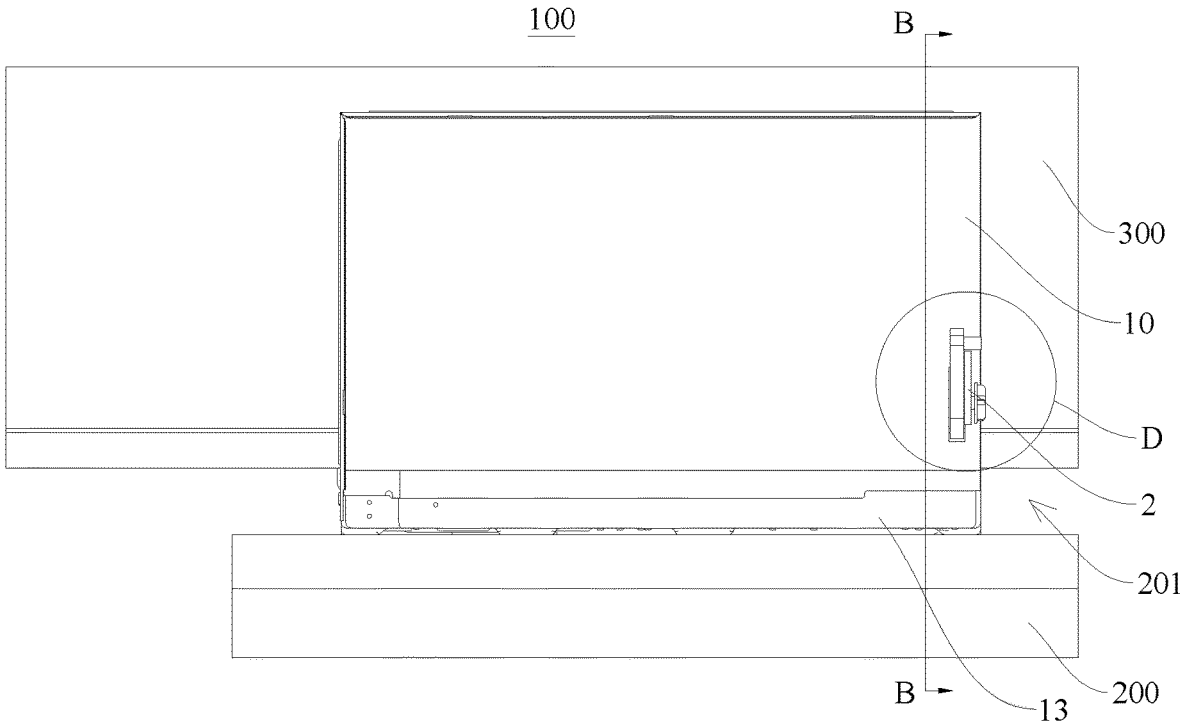
FIG. 8 is a left view of a window air conditioner according to some embodiments of the present disclosure.
Figure 9:
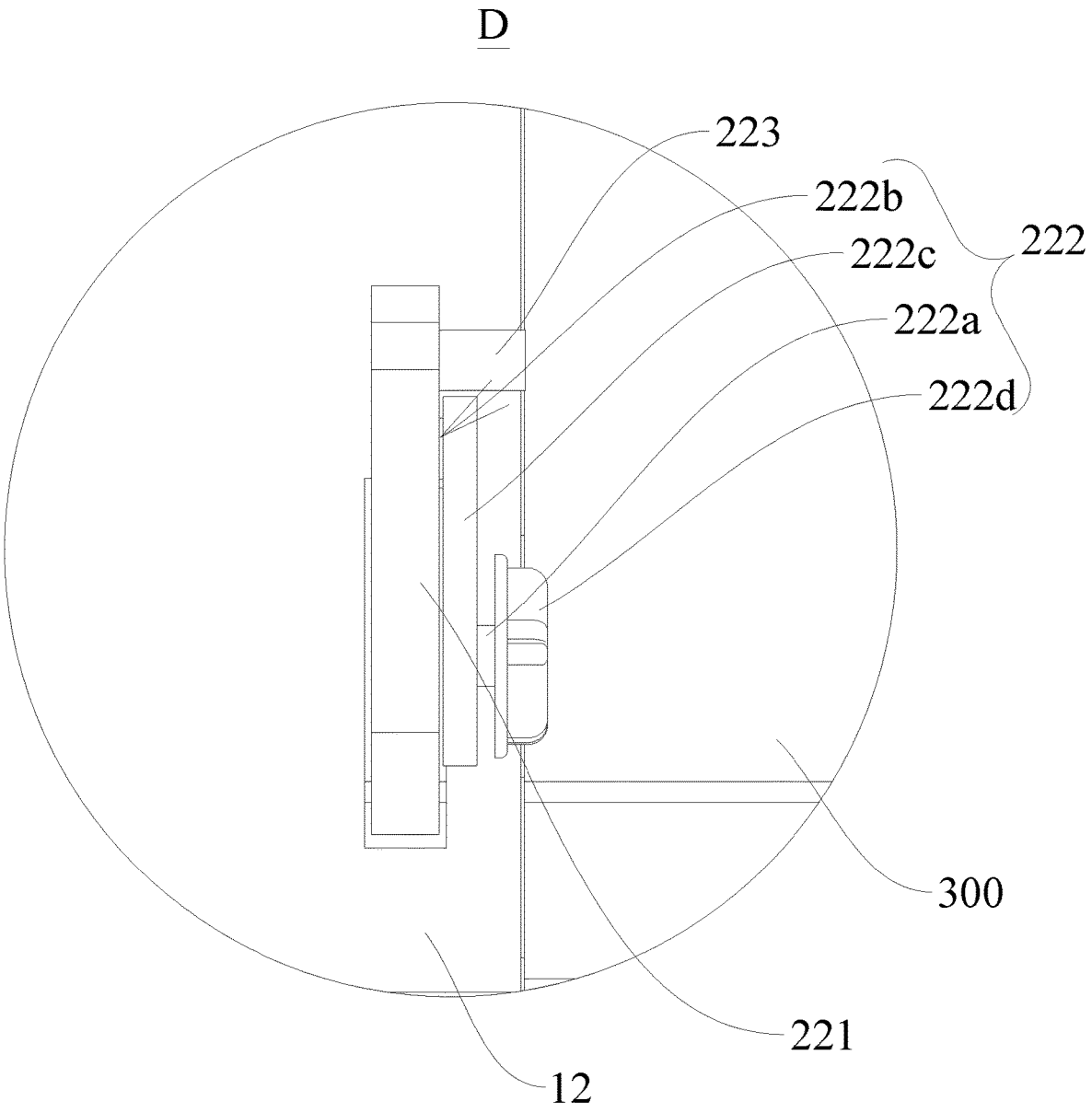
FIG. 9 is an enlarged view of a part D in FIG. 8.
Figure 10:
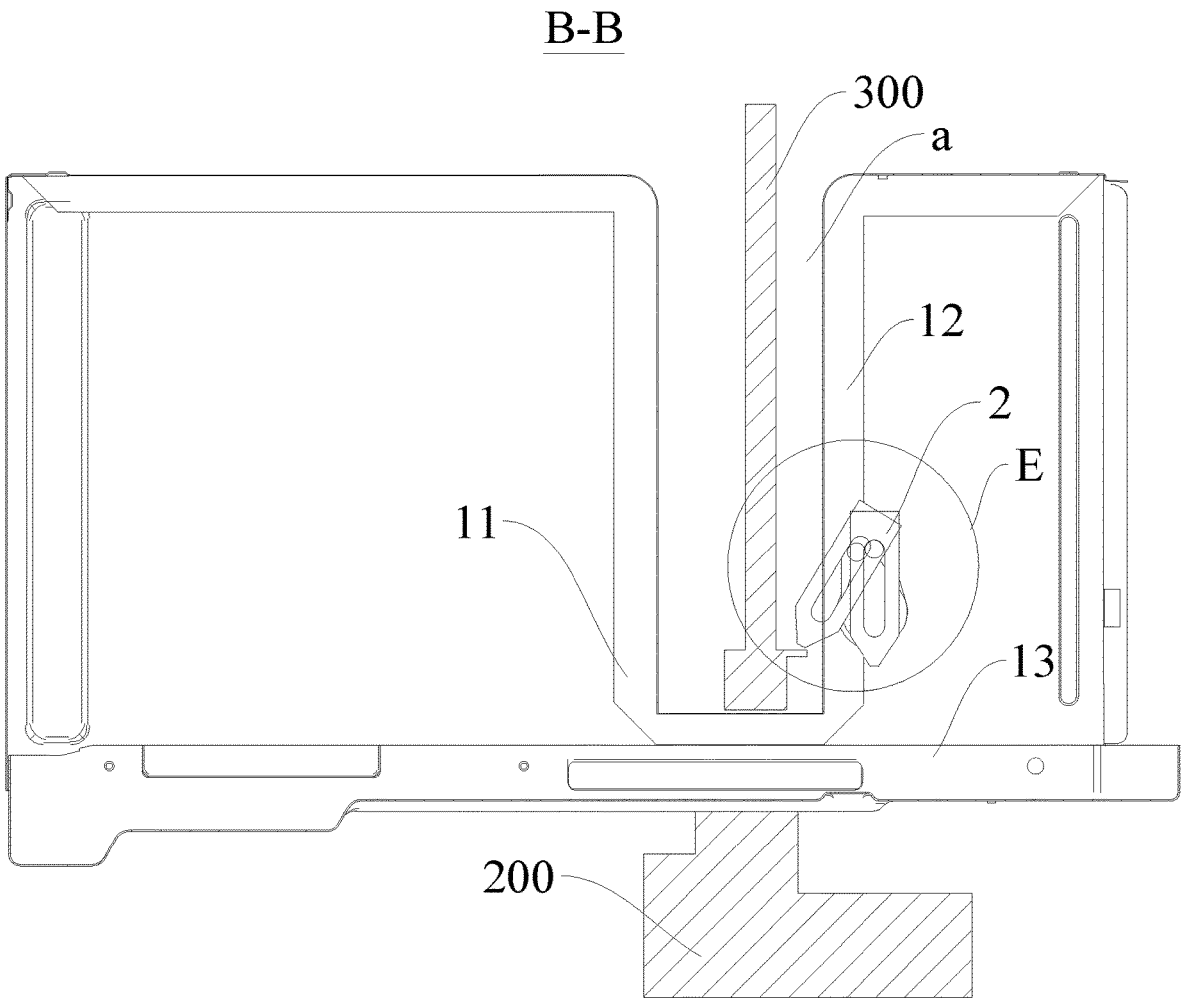
FIG. 10 is a sectional view along a line B-B in FIG. 8.
Figure 11:
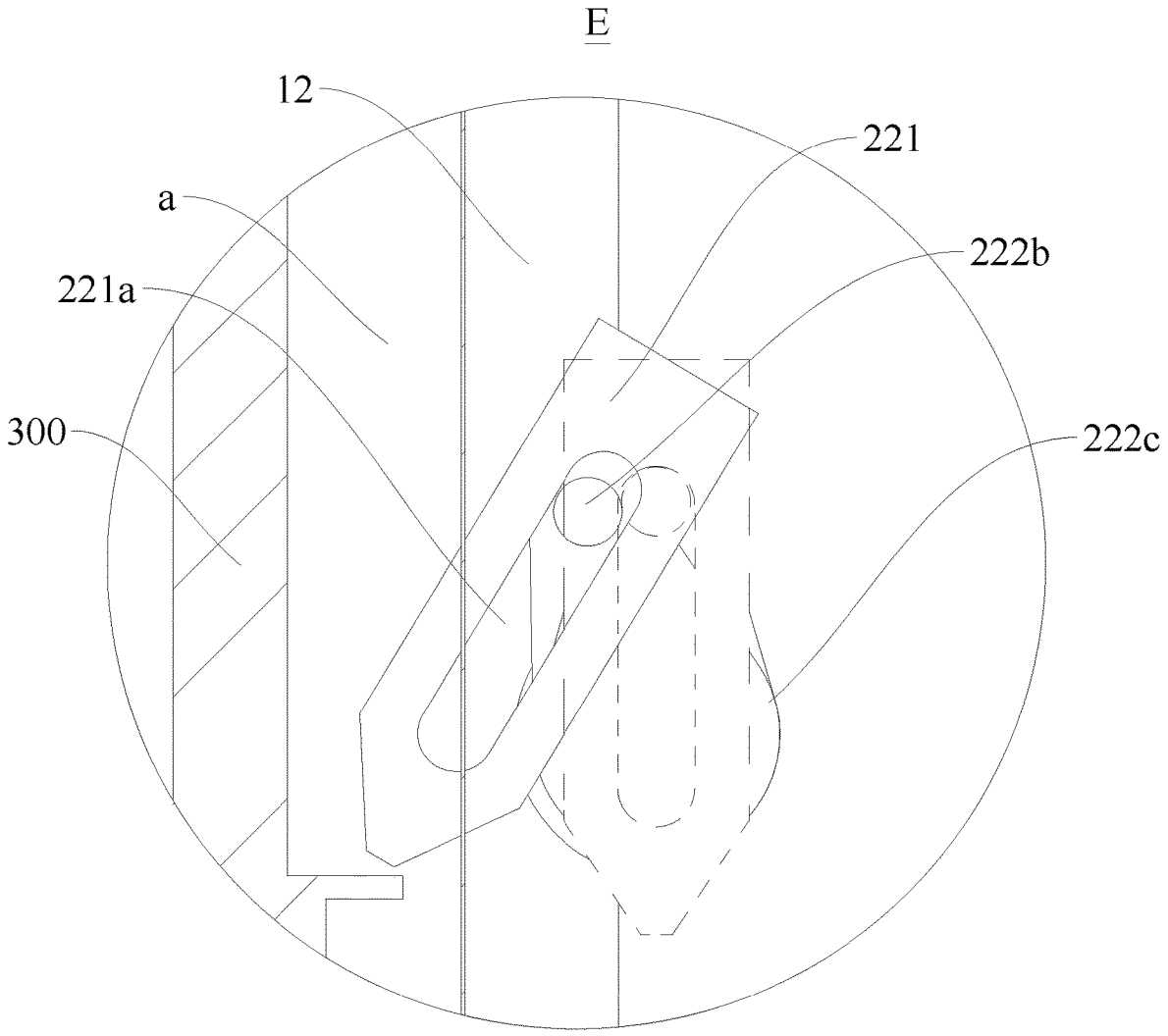
FIG. 11 is an enlarged view of a part E in FIG. 10.
Figure 12:
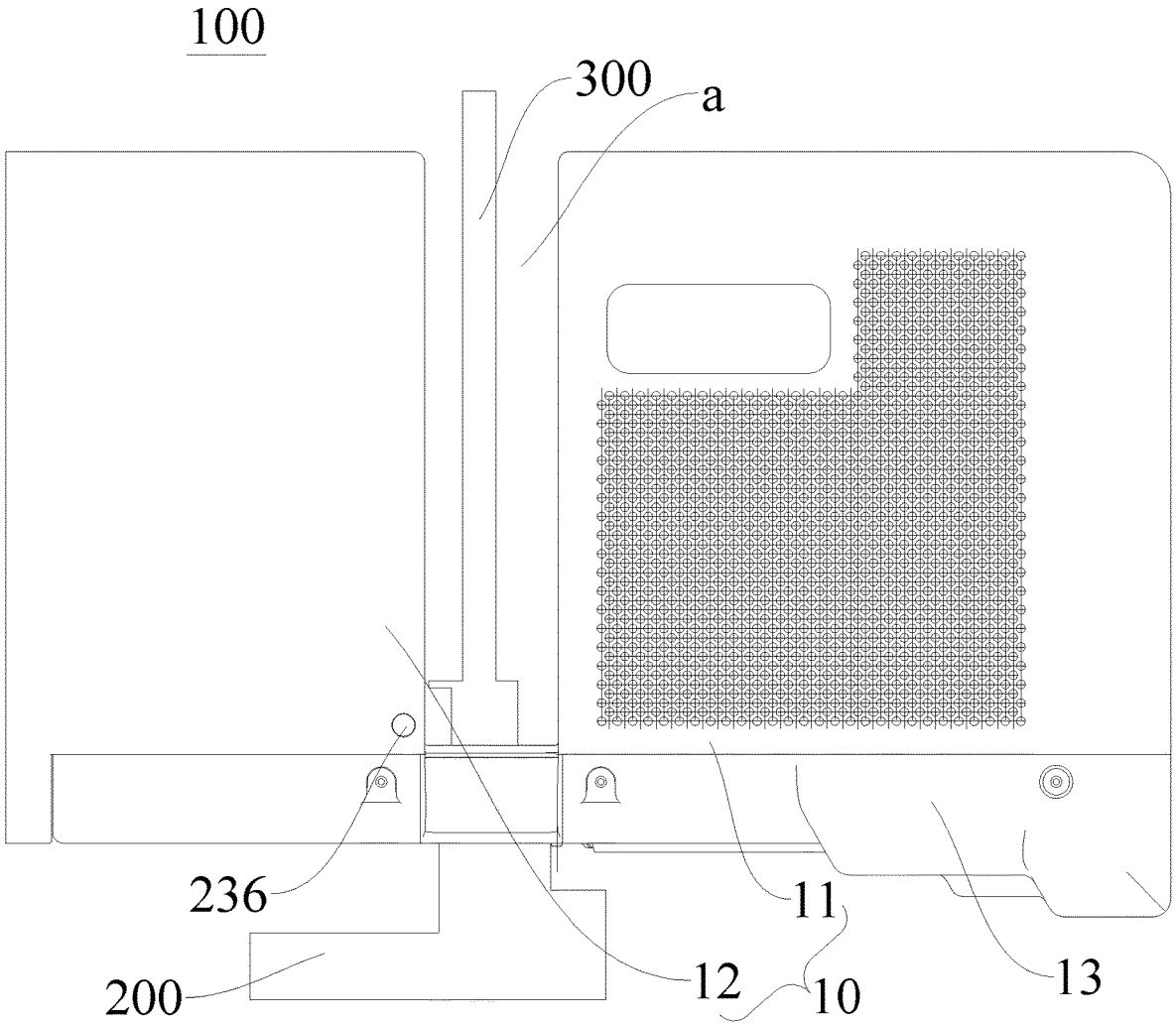
FIG. 12 is a front view of a window air conditioner according to some embodiments of the present disclosure.
Figure 13:
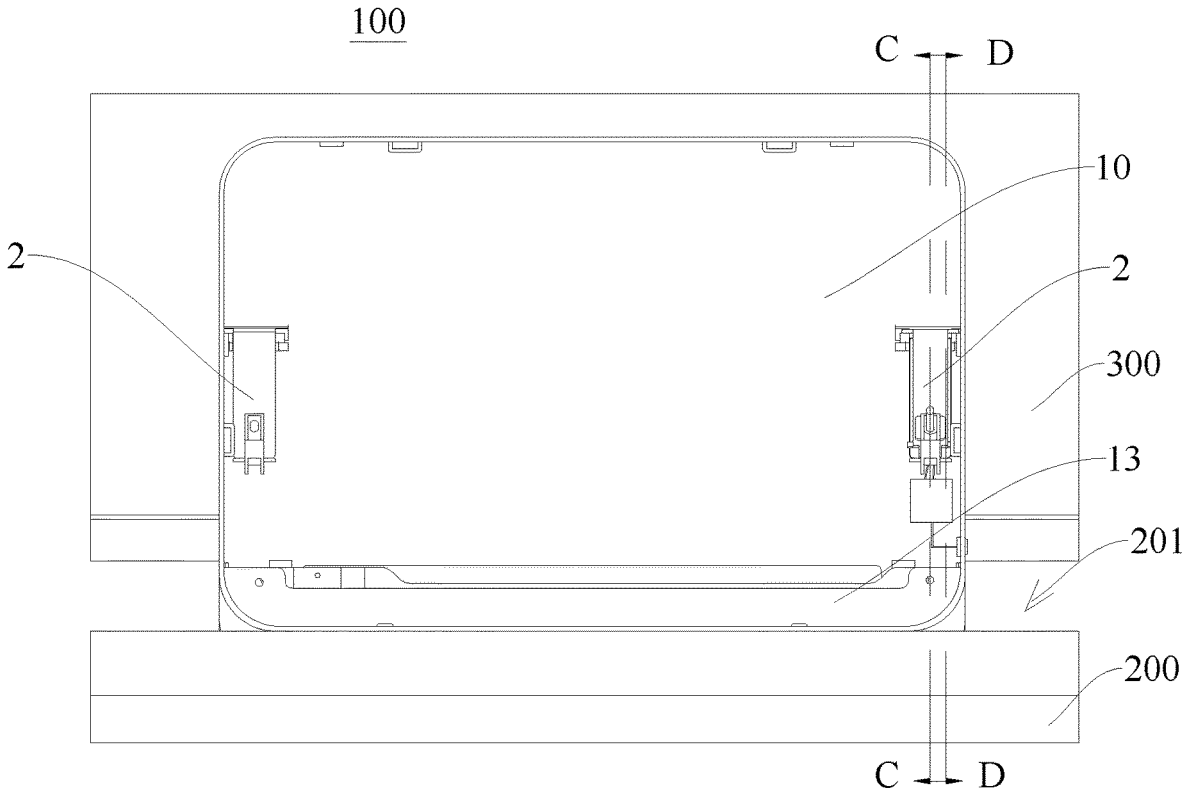
FIG. 13 is a left view of a window air conditioner according to some embodiments of the present disclosure.
Figure 14:
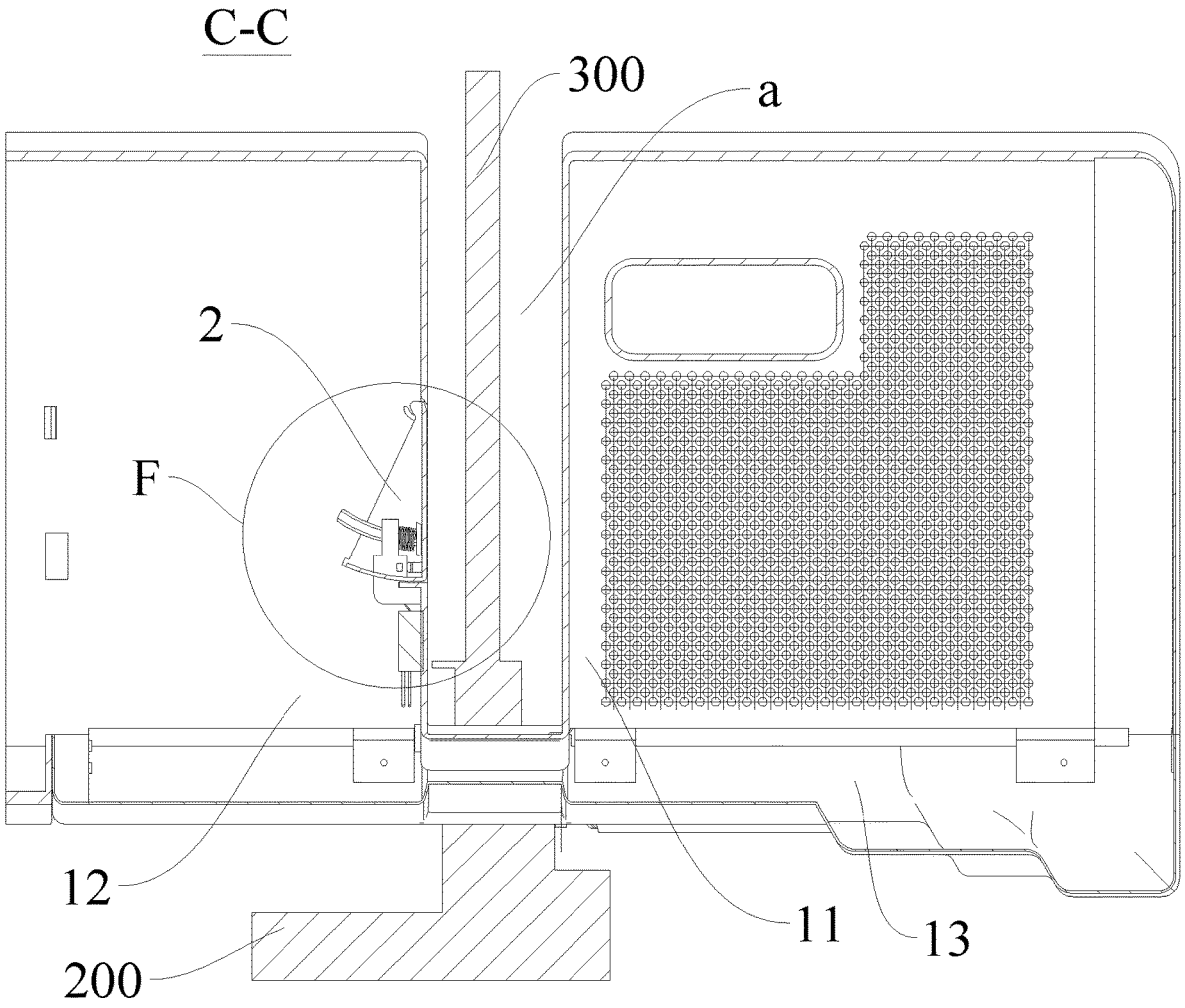
FIG. 14 is a sectional view along a line C-C in FIG. 13.
Figure 15:
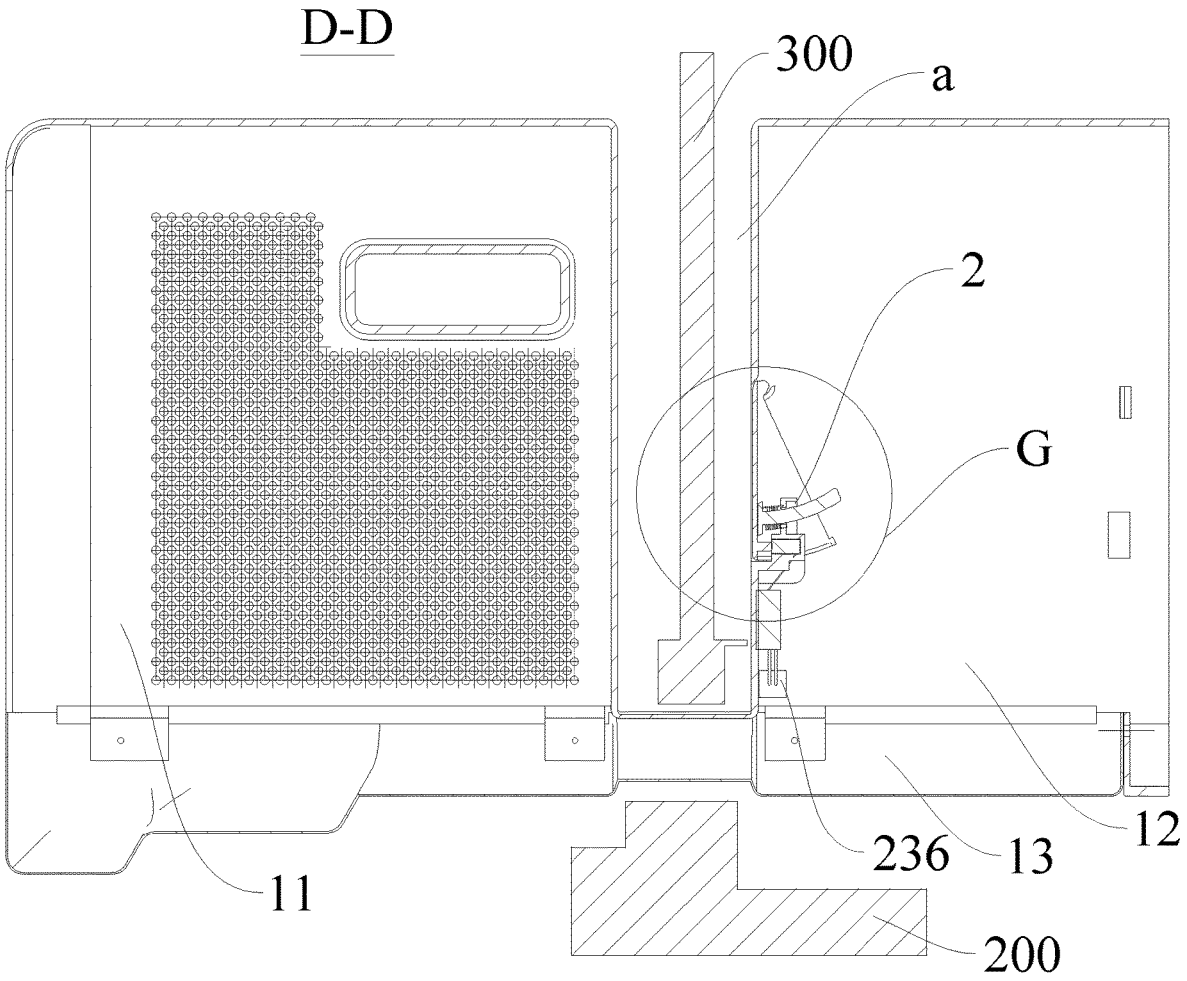
FIG. 15 is a sectional view along a line D-D in FIG. 13.

In addition, as illustrated in FIGS. 7 and 9, the rotating drive member 222 includes a cam 222*c*, and the cam 222*c* is rotatably arranged at the indoor part 12 through the pivot shaft 222*a*, and the drive shaft 222*b* is arranged at the cam 222*c*. Thus, the cam 222*c* rotates to drive the drive shaft 222*b* to slide in the sliding slot 221*a*, so as to drive the other end of the rotating member 221 to rotate, so that the positioning device 2 can switch between the locked state and the unlocked state. The arrangement of the cam 222*c* effectively ensures the reliability of the positioning device 2.

Furthermore, as illustrated in FIGS. 7 and 9, the rotating drive member 222 also includes a rotating knob 222*d*, and the rotating knob 222*d* is arranged at the cam 222*c* to drive the cam 222*c* to rotate. That is, the user may control the cam 222*c* to rotate by rotating the rotating knob 222*d*, so as to drive the drive shaft 222*b* to drive the other end of the rotating member 221 to rotate, so that the positioning device 2 can switch between the locked state and the unlocked state. Hence, the reliability of the positioning device 2 is further ensured, the user's operation is facilitated and the user's comfort is improved.

Specifically, at least a part of the rotating knob 222*d* is arranged outside the indoor part 12. Thus, it is convenient for the user to rotate the knob 222*d*, thereby improving the comfort of the user operating the positioning device 2.

Furthermore, the rotating knob 222*d* is arranged at a left side and/or a right side of the indoor part 12. Thus, it is convenient for the user to operate the rotating knob 222*d* indoors, thereby improving user's comfort.

Optionally, the sliding slot 221*a* runs through the rotating member 221 in a thickness direction of the rotating member 221. Thus, the reliability of the drive shaft 222*b* sliding in the sliding slot 221*a* can be effectively ensured, thereby ensuring the reliability of the positioning device 2.

Specifically, the other end of the rotating member 221 is formed to have a cone shape. Thus, the reliability of the fit between the other end of the rotating member 221 and the window 300 can be effectively ensured. That is, the reliability of the positioning device 2 positioning the window 300 is ensured. The other end of the rotating member 221 is not limited to having a cone shape, but may also be formed to have other shapes, as long as the reliability of the positioning device 2 positioning the window 300 is ensured.

Specifically, as illustrated in FIG. 9, the positioning device 2 includes a rotating shaft 223, and the rotating shaft 223 is fixed to an inner wall on the left side and/or the right side of the indoor part 12, and the one end of the rotating member 221 is rotatably arranged at the rotating shaft 223. Thus, the rotating member 221 may be driven by the drive shaft 222*b* to rotate with respect to the rotating shaft 223, so that the positioning device 2 may switch between the locked state and the unlocked state.

As illustrated in FIGS. 12-17, according to some other embodiments of the present disclosure, the positioning device 2 includes a cover 231, a second magnetic member 233 and a second elastic member 234.

One end of the cover 231 is rotatably arranged at the indoor part 12, and the cover 231 is provided with a first magnetic member 232. The second magnetic member 233 is arranged at the indoor part 12. When the second magnetic member 233 is in a power-off state, it is nonmagnetic. When the second magnetic member 233 is in a power-on state, the second magnetic member 233 and the first magnetic member 232 attract each other to control the cover 231 to rotate to the unlocked state. An end of the second elastic member 234 abuts against the cover 231, so as to normally push the cover 231 to rotate to the locked state.

Thus, in embodiments of the present disclosure, without an external force, the cover 231 normally rotates to the locked state driven by the second elastic member 234. When the second magnetic member 233 is powered on, the second magnetic member 233 and the first magnetic member 232 of the cover 231 attract each other, and then the cover 231 overcomes a push force of the second elastic member 234 and rotates to the unlocked state so as to be separated from the window 300. That is, in the window air conditioner 100 according to embodiments of the present disclosure, the positioning device 2 may be controlled to be in the locked state or the unlocked state by controlling the power on and the power off of the second magnetic member 233.

Thus, in the process of placing the window 300 in the receiving groove a, the second magnetic member 233 may be controlled to be powered on, so that the second magnetic member 233 is attracted to the first magnetic member 232 of the cover 231. Thus, the cover 231 overcomes the push force of the second elastic member 234 and rotates to the unlocked state, such that it is ensured that there is a gap between the positioning device 2 and the window 300, and hence the window 300 can be placed in the receiving groove a. After the window 300 is placed in position, the second magnetic member 233 may be controlled to be powered off, and then the cover 231 rotates to the locked state under the push of the second elastic member 234, so that the cover 231 may be fitted with the window 300 effectively to position the window 300.

When the user needs to move at least a part of the window 300 out of the receiving groove a, he/she only needs to control the second magnetic member 233 to be powered on so that the second magnetic member 233 attracts the first magnetic member 232 of the cover 231, and then the cover 231 overcomes the push force of the second elastic member 234 and rotates to the unlocked state. Thus, the positioning device 2 is separated from the window 300, and it is ensured that the at least part of the window 300 can be moved out the receiving groove a.

It should be understood that, in the case of power outage, the user may manually press the cover 231 which is in the locked state so that the cover 231 overcomes the push force of the second elastic member 234 and rotates to the unlocked state. Thus, the positioning device 2 is separated from the window 300, and it is ensured that the at least part of the window 300 can be moved out of the receiving groove a. Therefore, the usage flexibility of the positioning device 2 is improved.

Furthermore, as illustrated in FIGS. 12 and 15-17, the positioning device 2 also includes a battery box 235 and a switch 236. The battery box 235 is arranged in the indoor part 12 and electrically connected with the second magnetic member 233. The switch 236 is arranged at an outer side wall of the indoor part 12. The switch 236 is electrically connected with the battery box 235 to control the second magnetic member 233 to be powered on or off. Thus, the second magnetic member 233 is powered by the battery box 235. The power on and the power off of the second magnetic member 233 are controlled by the switch 236. The user may directly control the power on and the power off of the second magnetic member 233 through the switch 236 indoors, so that the way of controlling the positioning device 2 to be in the locked state or the unlocked state is simple for the user, thus effectively improving the user's comfort.

Figure 16:
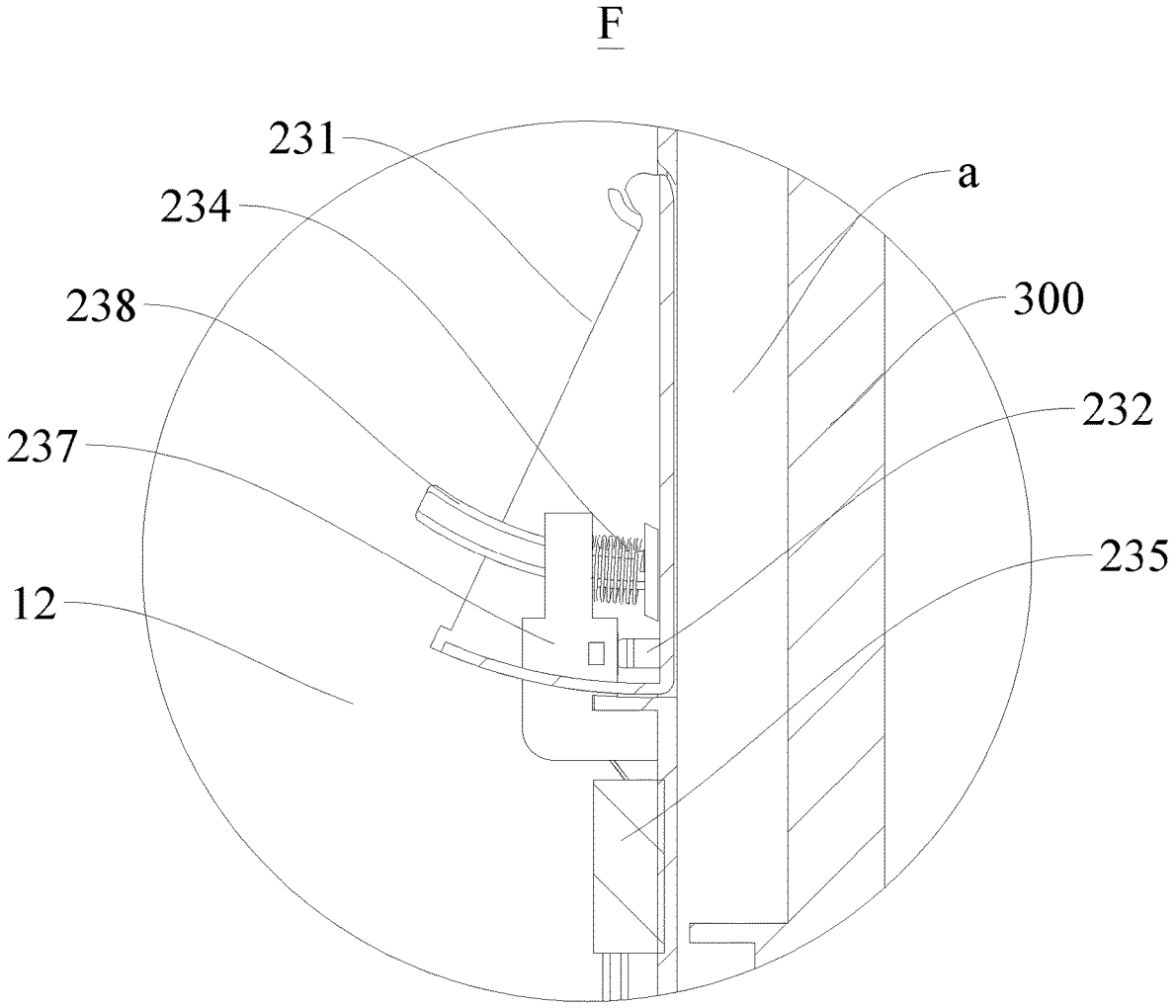
FIG. 16 is an enlarged view of a part F in FIG. 14.
Figure 17:
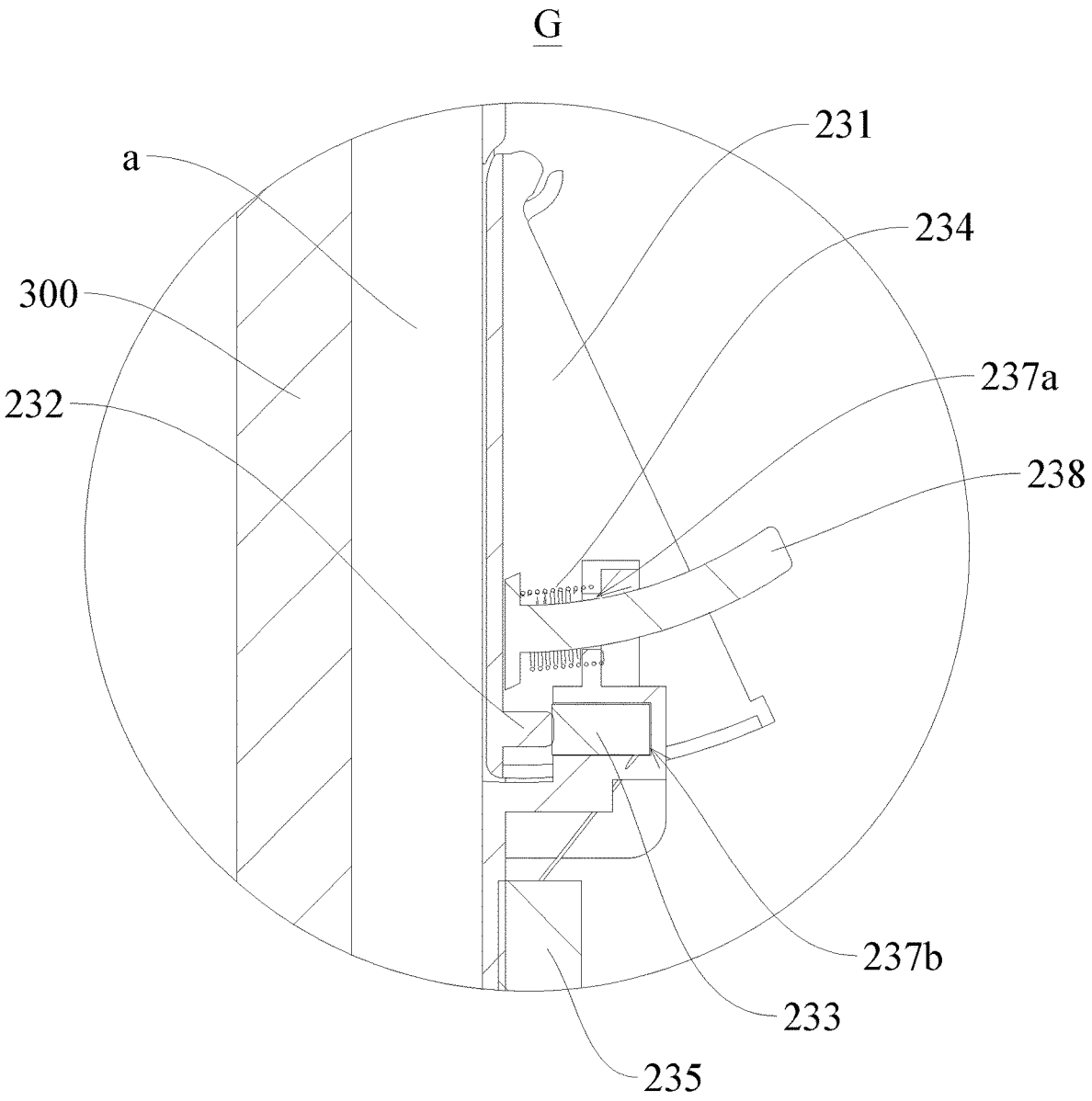
FIG. 17 is an enlarged view of a part G in FIG. 15.

In addition, as illustrated in FIGS. 16 and 17, the positioning device 2 also includes a position limiting structure 237 and a support bar 238. The position limiting structure 237 is arranged at the indoor part 12, and the support bar 238 is fixed to the cover 231. The support bar 238 passes through the position limiting structure 237, and is movable with respect to the position limiting structure 237. The second elastic member 234 is sleeved over the support bar 238, and the two ends of the second elastic member 234 abut against the support bar 238 and the position limiting structure 237, respectively. Thus, the support bar 238 is arranged at an inner side of the cover 231. The arrangement of the support bar 238 and the position limiting structure 237 ensures the push force of the second elastic member 234 to the cover 231, and also helps to restrict a rotation path of the cover 231, so as to avoid the influence on the reliability of the positioning device 2 caused by the cover 231 deviated from the rotation path due to a long-term rotation to a certain degree, thus improving the reliability of the positioning device 2 and the reliability of the window air conditioner 100.

Specifically, as illustrated in FIG. 17, the position limiting structure 237 is provided with a position limiting through hole 237*a*, and the support bar 238 passes through the position limiting through hole 237*a* so as to move with respect to the position limiting structure 237. Thus, the reliability of the overall structure of the positioning device 2 is improved, the rotation path of the cover 231 is further restricted, and the reliability of the window air conditioner 100 is improved.

Furthermore, as illustrated in FIG. 17, the position limiting structure 237 is provided with a mounting groove 237*b* whose opening faces to the cover 231, and the second magnetic member 233 is arranged in the mounting groove 237*b*. When the cover 231 is in the unlocked state, the first magnetic member 232 is attached to the second magnetic member 233. Thus, an attracting force between the second magnetic member 233 and the first magnetic member 232 is ensured when the second magnetic member 233 is powered on, and also it is convenient to mount and position the second magnetic member 233, such that the reliability of the structure of the positioning device 2 can be improved to a certain degree, and the structure of the positioning device 2 is miniaturized.

Specifically, the indoor part 12 is provided with a through hole. In the unlocked state, the cover 231 is fitted in the through hole to close the through hole. In the locked state, at least a part of the cover 231 rotates to the outside of the through hole. That is, the cover 231 is formed by a part of the side wall of the indoor part 12, so as to reduce the manufacturing cost of the window air conditioner 100. Moreover, the cover 231 is arranged at the side wall of the indoor part 12 close to the outdoor part 11 in this case. Thus, the reliability of the positioning device 2 positioning the window 300 can be further ensured, and the light transmission effect of the window 300 can be ensured.

Optionally, a plurality of the positioning devices 2 are provided and spaced apart from one another along the width direction of the mounting opening 201. Thus, the window air conditioner 100 can effectively position the window 300 and the reliability of the window 300 being placed in the receiving groove a is ensured. Even if one of the plurality of the positioning devices 2 fails, the user may position the window 300 through the other positioning devices 2 of the window air conditioner 100, thus improving the reliability of the window air conditioner 100 and facilitating to prolong a service life of the window air conditioner 100.

According to some embodiments of the present disclosure, the casing 1 may include a chassis 13, and the chassis 13 may be arranged at a bottom of the cabinet 10 and disposed on the wall 200. The window air conditioner 100 also includes a sealing device 30, and a connecting end 34 of the sealing device 30 is connected with the casing 1.

As illustrated in FIGS. 18, 22, 25 and 30, the sealing device 30 includes a fixing member 31 and a sliding member 32.

Figure 30:
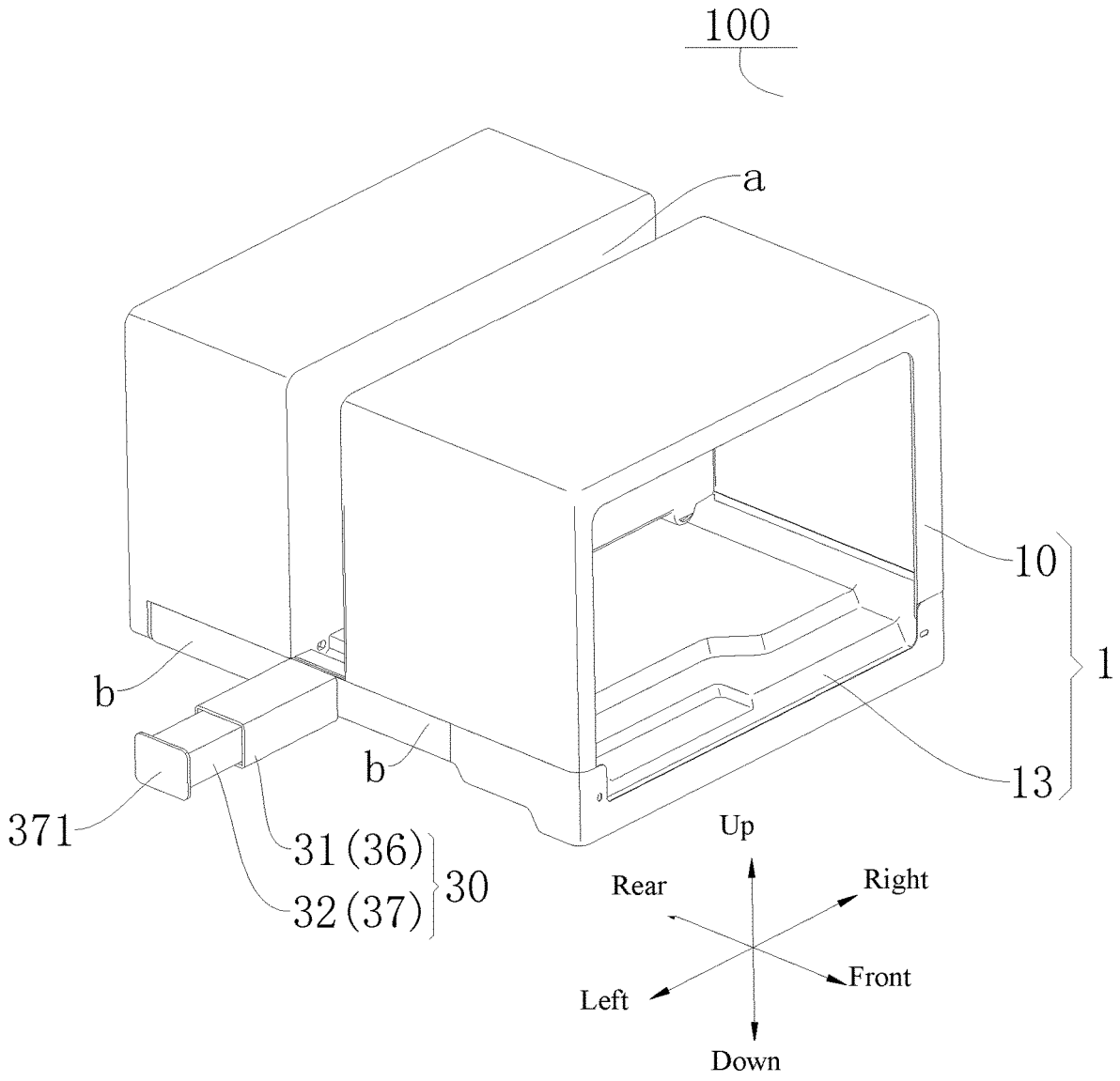
FIG. 30 is a schematic view of a window air conditioner according to some embodiments of the present disclosure, in which a sealing device is in a stretched stat.

As illustrated in FIG. 30, the fixing member 31 may be connected with the casing 1 of the window air conditioner 100, and the sliding member 32 may be slidably fitted with the fixing member 31. The sliding member 32 may have a first position and a second position. In the first position, the sliding member 32 may overlap the fixing member 31. In the second position, the sliding member 32 may slide out of the fixing member 31 and have contact with the mounting opening 201. The fixing member 31 and the sliding member 32 may have contact with the window 300 respectively, so as to seal a gap between the window 300 and the mounting opening 201.

Specifically, when the window air conditioner 100 is mounted, the window air conditioner 100 may be placed in the mounting opening 201. The window 300 may move up and down with respect to the wall 200. When the window 300 moves down, it may extend into the receiving groove a of the cabinet 10. Thus, the indoor part 12 of the window air conditioner 100 may be separated from the outdoor part 11 of the window air conditioner 100. It should be understood that, when the window air conditioner 100 is mounted, there is a gap between the window 300 and the mounting opening 201. If the gap is not sealed, the window air conditioner 100 is prone to have a cold air leakage, thus affecting the cooling and heating efficiency of the window air conditioner 100. The sealing device 30 may be used to seal the gap between the window 300 and the mounting opening 201, so as to prevent the window air conditioner 100 from having the cold air leakage, thus improving the sealing effect of the indoor space, and further improving the cooling and heating effect of the window air conditioner 100.

An end of the fixing member 31 may be fixedly connected with the casing 1 of the window air conditioner 100, and the sliding member 32 may slide with respect to the fixing member 31, so as to adjust a length of the sealing device 30. When the sealing device 30 is in transit, the sliding member 32 may be in the first position. In this case, the sliding member 32 and the fixing member 31 are overlapped, so as to reduce the occupied volume of the sealing device 30, thus facilitating the carriage of the sealing device 30. When the sealing device 30 is in operation, the sliding member 32 may be moved to the second position. In this case, the sliding member 32 and the fixing member 31 may be closely fitted with the inner wall of the mounting opening 201, respectively, so as to seal the gap between the mounting opening 201 and the window 300.

Optionally, when the sliding member 32 is in the second position, a sliding distance of the sliding member 32 with respect to the fixing member 31 may be selected and set according to an actual need. For example, when a distance between an outer peripheral wall of the casing 1 of the window air conditioner 100 and the inner wall of the mounting opening 201 is large, an extension distance of the sliding member 32 may be prolonged. When the distance between the outer peripheral wall of the casing 1 of the window air conditioner 100 and the inner wall of the mounting opening 201 is small, the extension distance of the sliding member 32 may be shortened. Thus, through the above arrangements, a usage flexibility may be improved for the user, and the sealing device 30 may be applied to different types of mounting openings 201, so as to improve the sealing effect of the sealing device 30.

Figure 32:
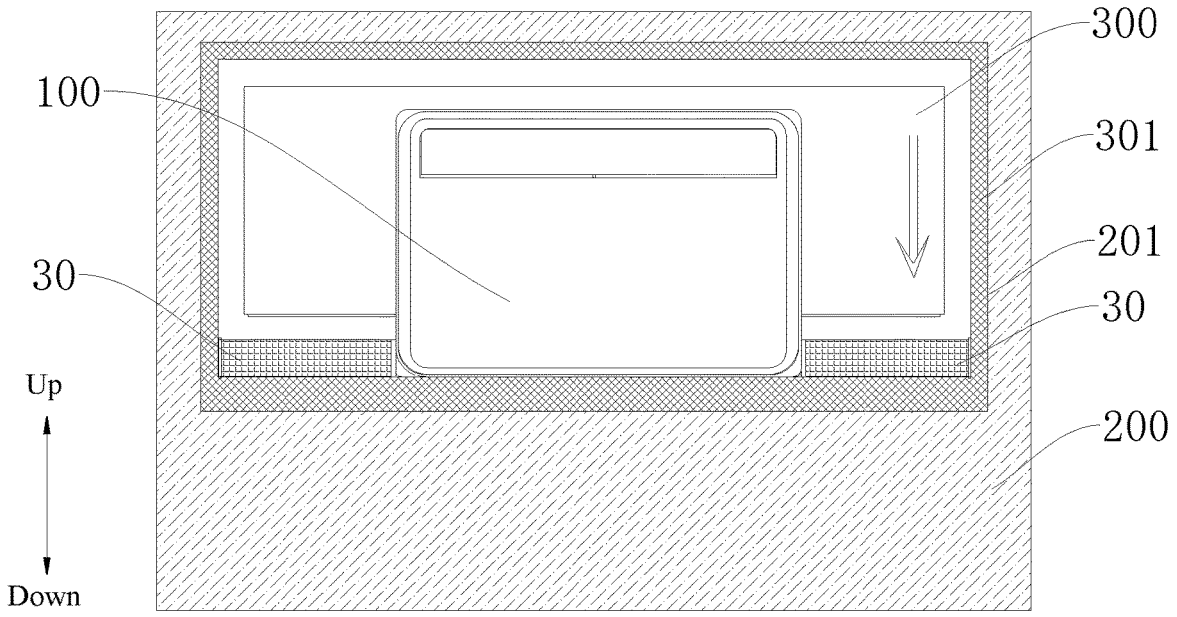
FIG. 32 is a schematic view illustrating a fit of a window air conditioner according to an embodiment of the present disclosure with a wall.

Optionally, as illustrated in FIG. 32, the inner wall of the mounting opening 201 may be provided with a window frame 301, and the chassis 13 may be arranged at the window frame 301, so as to improve the sealing effect between the mounting opening 201 and the window air conditioner 100. When the window air conditioner 100 is mounted, the window 300 may move downwards with respect to the wall 200 and extend into the receiving groove a, and the sealing device 30 may be closely fitted with an inner peripheral wall of the window frame 301, so as to improve the sealing effect between the window 300 and the mounting opening 201.

Optionally, the sealing device 30 may be a non-metallic part, and the non-metallic part has advantages of a light weight as well as easy mounting and dismounting. For example, the sealing device 30 may be made of non-metallic materials such as plastics, rubber and silica gel. Of course, the sealing device 30 may also be a metal part, and the metal part has advantages of a firm structure and a long service life. For example, the sealing device 30 may be a sheet-metal part.

Optionally, the sealing device 30 may have a detachable connection with the casing 1. The sealing device 30 may be configured to have different models. The different models of the sealing devices 30 may have different lengths and heights. Thus, an appropriate sealing device 30 may be selected according to a distance between the casing 1 and the mounting opening 201 and a height difference between a bottom wall of the receiving groove a and the inner wall of the mounting opening 201, so as to improve the applicability of the sealing device 30, thus resulting in a close fit structure between the sealing device 30 and the mounting opening 201 and hence providing a good sealing effect.

Figure 18:
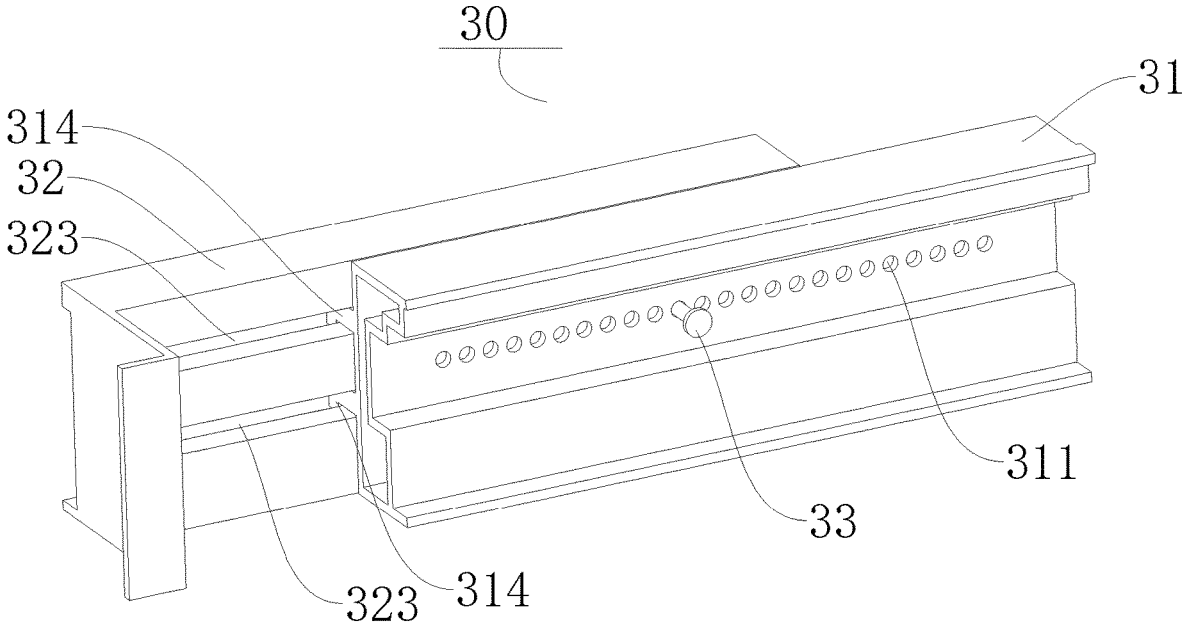
FIG. 18 is a schematic view of a sealing device according to some embodiments of the present disclosure.
Figure 19:
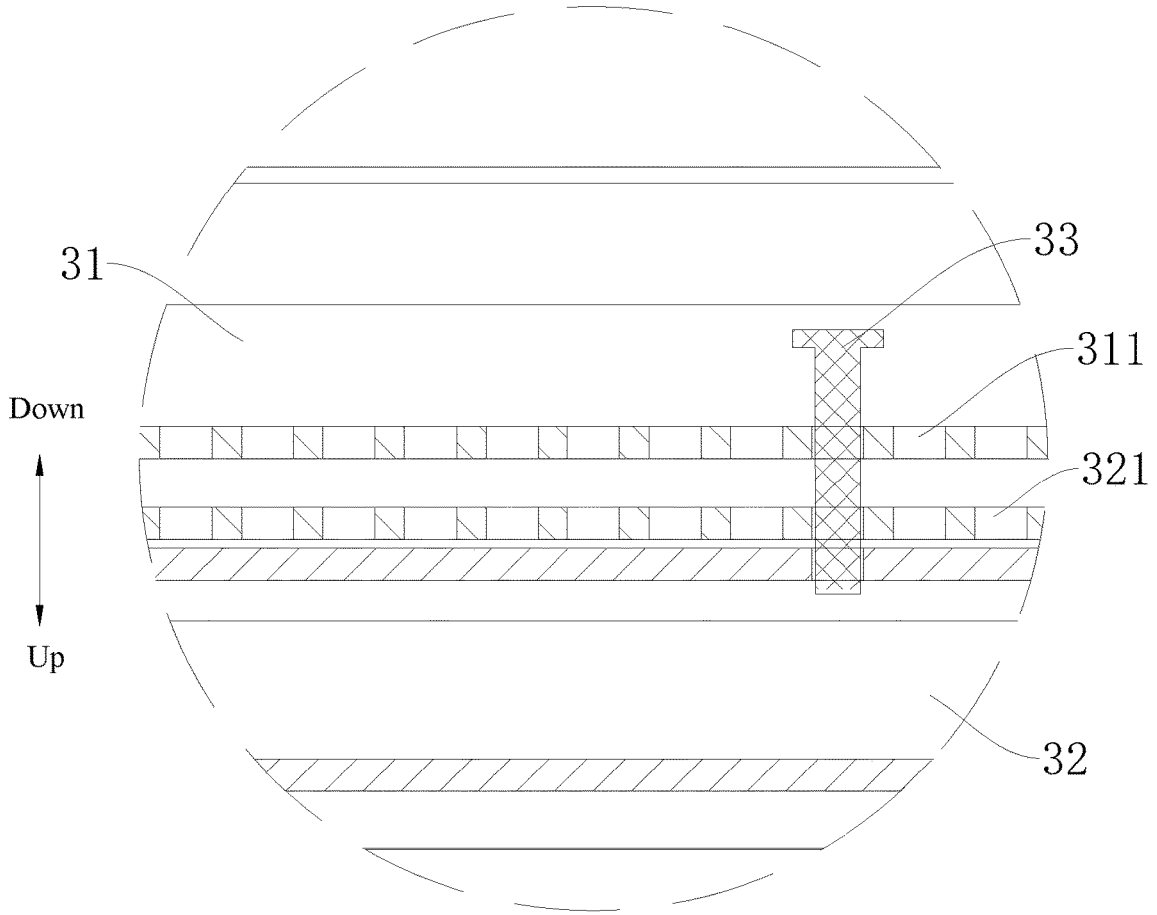
FIG. 19 is a schematic view illustrating a fit state of a locking element with a fixing member and a sliding member according to some embodiments of the present disclosure.

As illustrated in FIGS. 18-19, according to some embodiments of the present disclosure, the sealing device 30 may also include a locking member 33, the fixing member 31 is provided with a plurality of first positioning holes 311 spaced apart from one another and the sliding member 32 is provided with a plurality of second positioning holes 321 directly opposite to the first positioning holes 311. In the second position, the locking member 33 may pass through the first positioning hole 311 to be fitted with the second positioning hole 321 so as to position the sliding member 32, thus improving the sealing effect of the sealing device 30.

Specifically, the locking member 33 may position the sliding member 32. When the sliding member 32 is in the second position, the locking member 33 may prevent the sliding member 32 from moving with respect to the mounting opening 201, so as to ensure that the sliding member 32 is closely fitted with the inner wall of the mounting opening 201. In the specific example illustrated in FIG. 19, the fixing member 31 is provided with the plurality of first positioning holes 311 running through the fixing member 31 along an up and down direction. The sliding member 32 is provided with the plurality of second positioning holes 311 running through the sliding member 32 along the up and down direction. A distance between two adjacent first positioning holes 311 is the same with that between two adjacent second positioning holes 321. Thus, the first positioning hole 311 may be easily aligned with the second positioning hole 321 through the above configurations, such that it is ensured that the locking member 33 can be smoothly inserted into the first positioning hole 311 and the second positioning hole 321. Optionally, the locking member 33 may be a positioning pin, and the positioning pin is easy to process and low in cost, thus reducing a usage cost of the sealing device 30.

Figure 25:
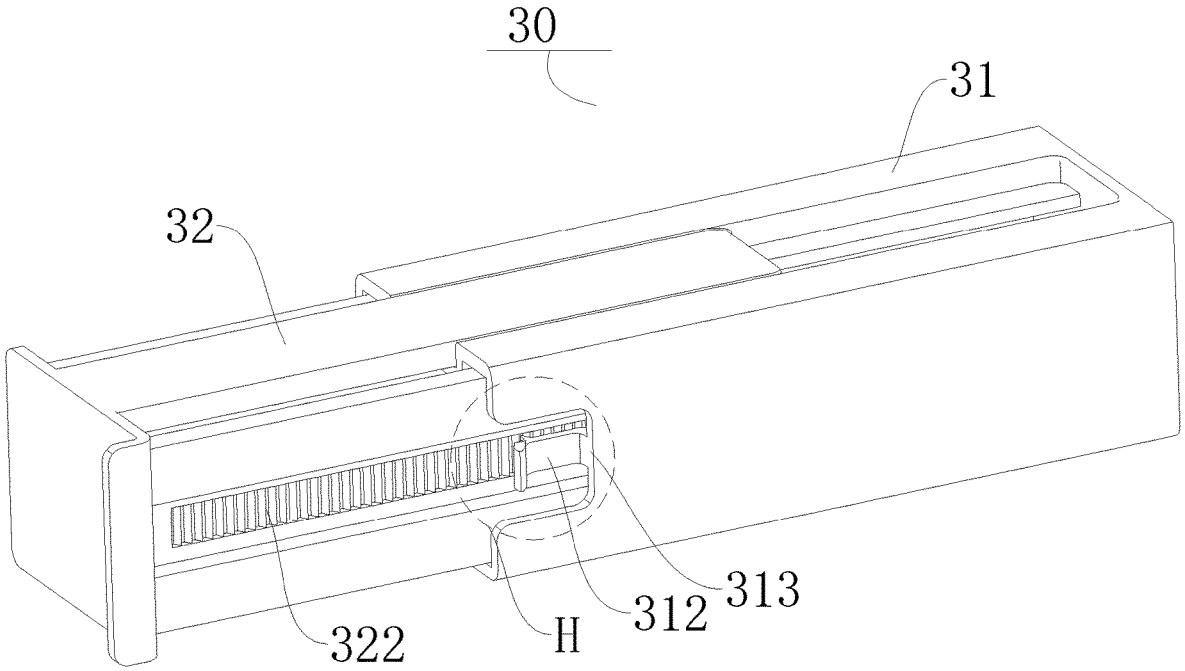
FIG. 25 is a schematic view of a sealing device according to some embodiments of the present disclosure.
Figure 26:
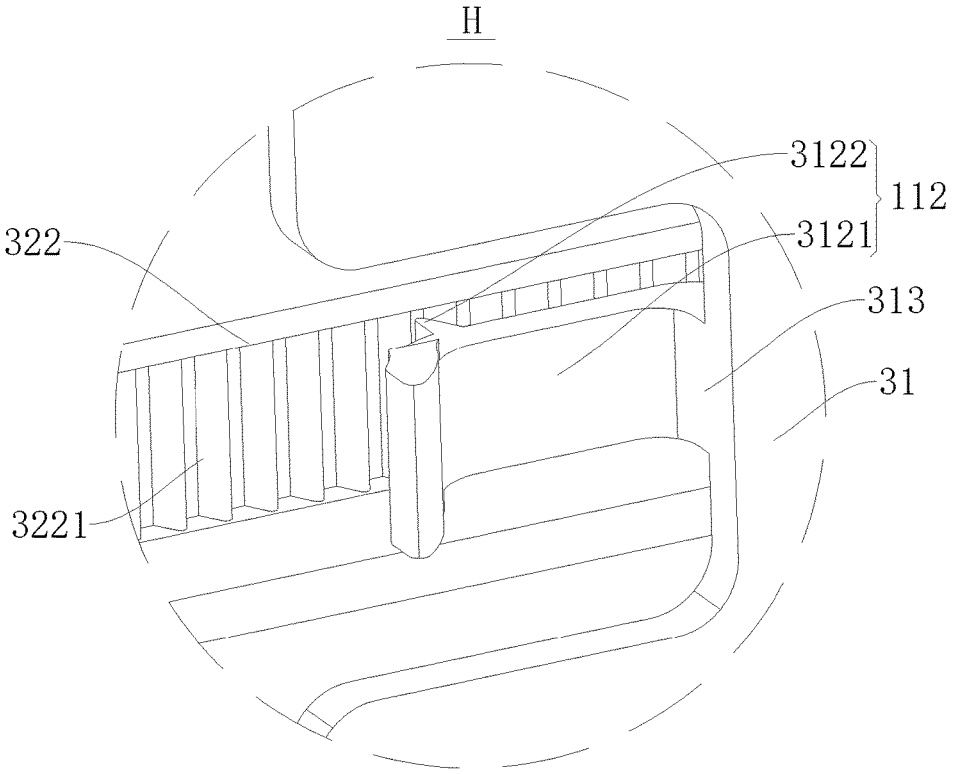
FIG. 26 is an enlarged view of a part H in FIG. 25.

As illustrated in FIGS. 25-26, according to some embodiments of the present disclosure, one of the fixing member 31 and the sliding member 32 may be provided with a positioning part 312, and the other one of the fixing member 31 and the sliding member 32 may be provided with a sliding guide rail 322 fitted with the positioning part 312. The positioning part 312 may have a deformed state and a positioned state, and the sliding guide rail 322 may have a plurality of positioning grooves 3221 spaced apart from one another along a length direction of the sliding guide rail 322. In the positioned state, at least a part of the positioning part 312 may extend into the positioning groove 3221 to only restrict the degree of freedom of movement of the sliding member 32 in a direction approaching the fixing member 31. In the deformed state, the positioning part 312 may be separated from the positioning groove 3221. Thus, the fit of the fixing member 31 and the sliding member 32 may be firm, and the sealing effect of the sealing device 30 may also be improved.

Specifically, the fixing member 31 may be provided with the positioning part 312, and the sliding member 32 may be provided with the sliding guide rail 322. Or, the fixing member 31 is provided with the sliding guide rail 322, and the sliding member 32 is provided with the positioning part 312. When the positioning part 312 is in the positioned state, the positioning part 312 always extends into the positioning groove 3221 of the sliding guide rail 322, and the sliding member 32 may slide freely in a direction running away from the fixing member 31. When the sliding member 32 slides in the direction approaching the fixing member 31, the positioning part 312 may abut against an inner peripheral wall of the positioning groove 3221 so as to prevent the sliding member 32 in the second position from sliding in the direction approaching the fixing member 31, so that it is ensured that the sliding member 32 is closely fitted with the inner wall of the mounting opening 201. When the distance between the window air conditioner 100 and the mounting opening 201 shortens, the positioning part 312 may be in the deformed state, and the positioning part 312 may be separated from the positioning groove 3221. Thus, the positioning part 312 may slide freely.

Figure 27:
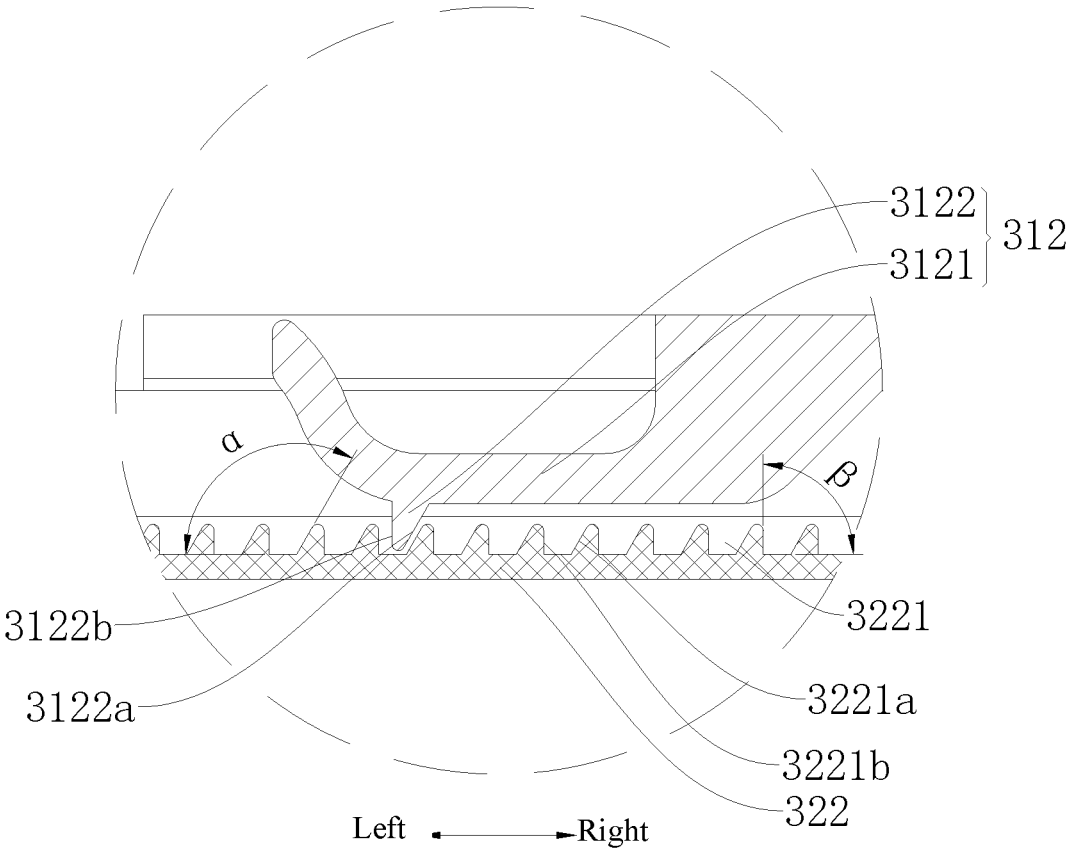
FIG. 27 is a schematic view illustrating a fit state of a positioning part and a sliding guide rail according to an embodiment of the present disclosure.

As illustrated in FIG. 27, in some embodiments of the present disclosure, the positioning part 312 may have a first inclined surface 3122*a* and a second inclined surface 3122*b*. An included angle α between the first inclined surface 3122*a* and a reference plane is larger than 90 degrees, and an included angle β between the second inclined surface 3122*b* and the reference plane is 90 degrees. The reference plane may be a horizontal plane parallel to an extension direction of the sliding guide rail 322. Each positioning groove 3221 may have a third inclined surface 3221*a* and a fourth inclined surface 3221*b*, the third inclined surface 3221*a* may be arranged parallel to the first inclined surface 3122*a*, and the fourth inclined surface 3221*b* may be arranged parallel to the second inclined surface 3122*b*. When the sliding member 32 moves in the direction running away from the fixing member 31, the first inclined surface 3122*a* and the third inclined surface 3221*a* are slidably fitted with each other. When the sliding member 32 moves in the direction approaching the fixing member 31, the second inclined surface 3122*b* abuts against the fourth inclined surface 3221*b* to restrict the movement of the sliding member 32. Thus, by the above configuration, the fit between the positioning part 312 and the sliding guide rail 322 is simple and the positioning effect is great.

For example, as illustrated in FIG. 27, the positioning part 312 includes a connecting arm 3121 and an assembling protrusion 3122, the connecting arm 3121 may be connected with the sliding member 32 or the fixing member 31, and the assembling protrusion 3122 is connected to the connecting arm 3121 and extends into the positioning groove 3221. The assembling protrusion 3122 has the first inclined surface 3122*a* and the second inclined surface 3122*b*. The included angle α between the first inclined surface 3122*a* and the horizontal plane is 120 degrees, and the included angle β between the second inclined surface 3122*b* and the horizontal plane is 90 degrees. The positioning groove 3221 has the third inclined surface 3221*a* and the fourth inclined surface 3221*b* arranged opposite to each other in a left and right direction. The third inclined surface 3221*a* is arranged parallel to the first inclined surface 3122*a*, and the fourth inclined surface 3221*b* is arranged parallel to the second inclined surface 3122*b*. When the positioning part 312 is in the positioned state, the assembling protrusion 3122 always extends into the positioning groove 3221. When the positioning part 312 is in the deformed state, the connecting arm 3121 is elastically deformed, such that the assembling protrusion 3122 may be driven to be separated from the positioning groove 3221.

As illustrated in FIG. 26, in some embodiments of the present disclosure, one of the fixing member 31 or the sliding member 32 is provided with an assembling groove 313, and the positioning part 312 may be arranged in the assembling groove 313. The positioning part 312 has elasticity such that the overall structure of the sealing device 30 is compact. For example, the positioning part 312 may be arranged at the fixing member 31, and the fixing member 31 is provided with the assembling groove 313 for accommodating the positioning part 312, such that the overall structure of the positioning part 312 is compact. Since the positioning part 312 is elastic, the positioning part 312 may be elastically deformed, thus facilitating the separation of the positioning part 312 and the positioning groove 3221.

Figure 22:
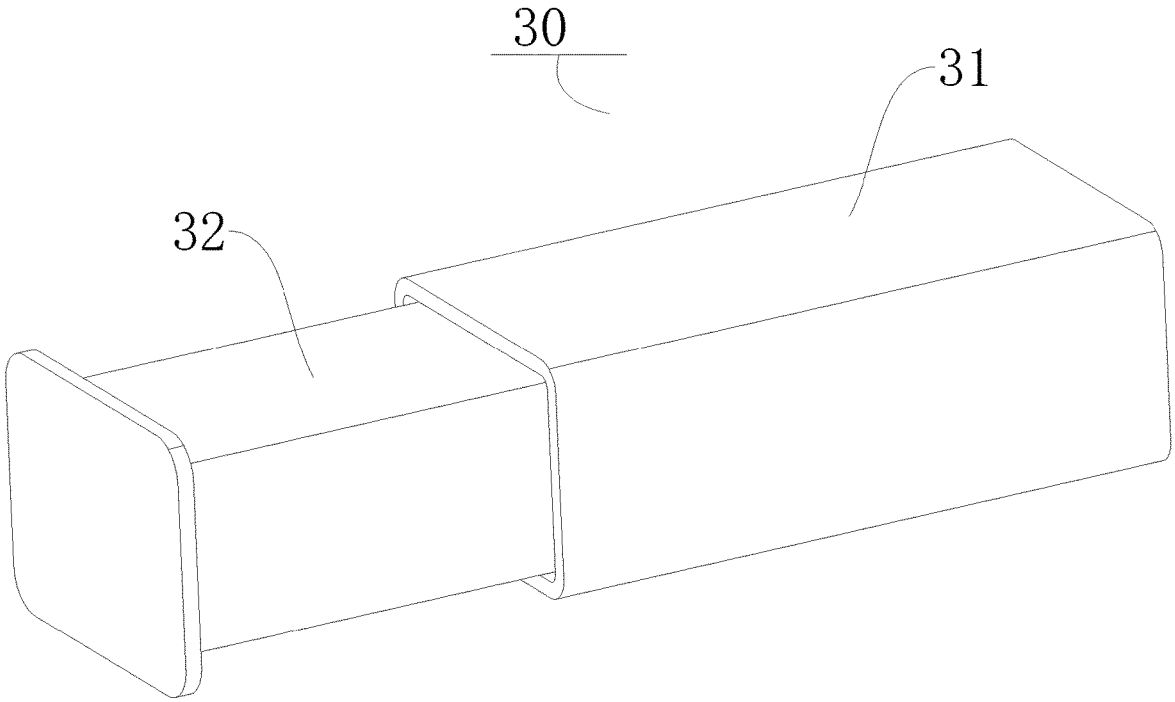
FIG. 22 is a schematic view of a sealing device according to some embodiments of the present disclosure.
Figure 23:
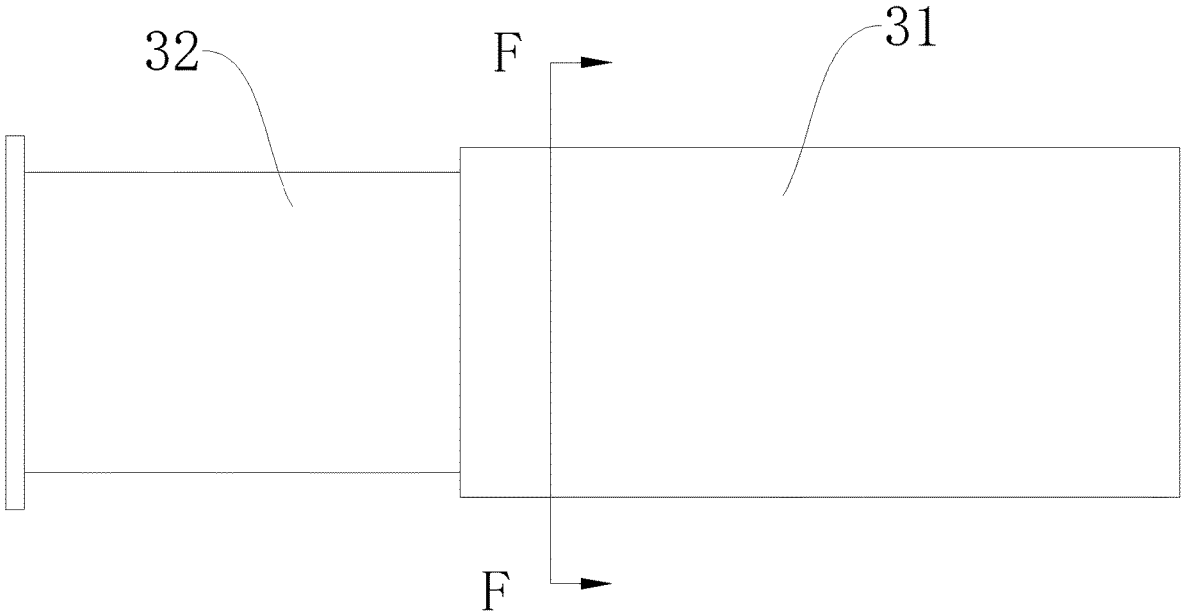
FIG. 23 is a front view of the sealing device in FIG. 22.
Figure 24:
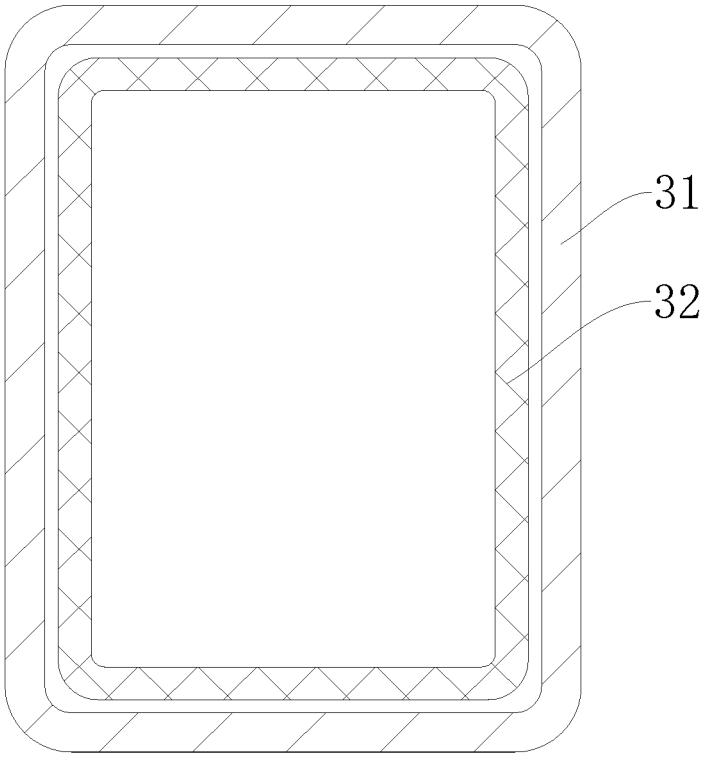
FIG. 24 is a sectional view along a line F-F in FIG. 23.

As illustrated in FIGS. 22-24, according to some embodiments of the present disclosure, the fixing member 31 may be sleeved over the sliding member 32. In the first position, the sliding member 32 may be received in the fixing member 31, such that the fit of the fixing member 31 and the sliding member 32 is simple. Optionally, both the fixing member 31 and the sliding member 32 may be configured as hollow members, and at least one of the fixing member 31 and the sliding member 32 may be provided with a heat insulation layer. That is, the heat insulation layer may be provided only on an inner wall of the fixing member 31, or only on an inner wall of the sliding member 32, or both on the inner wall of the fixing member 31 and on the inner wall of the sliding member 32 at the same time, so as to improve the heat insulation effect of the sealing device 30. Furthermore, the heat insulation layer may be made of rubber materials or foam materials.

Figure 20:
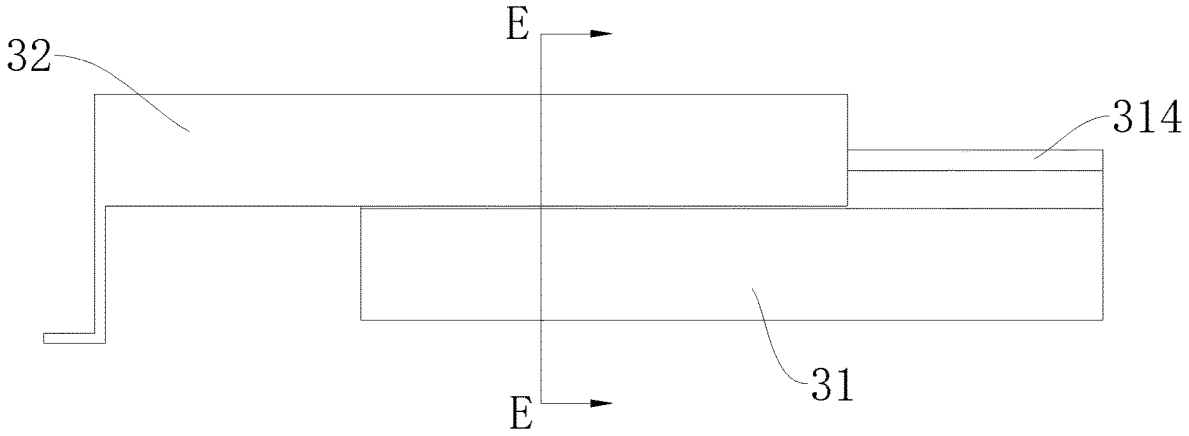
FIG. 20 is a front view of a sealing device according to some embodiments of the present disclosure.
Figure 21:
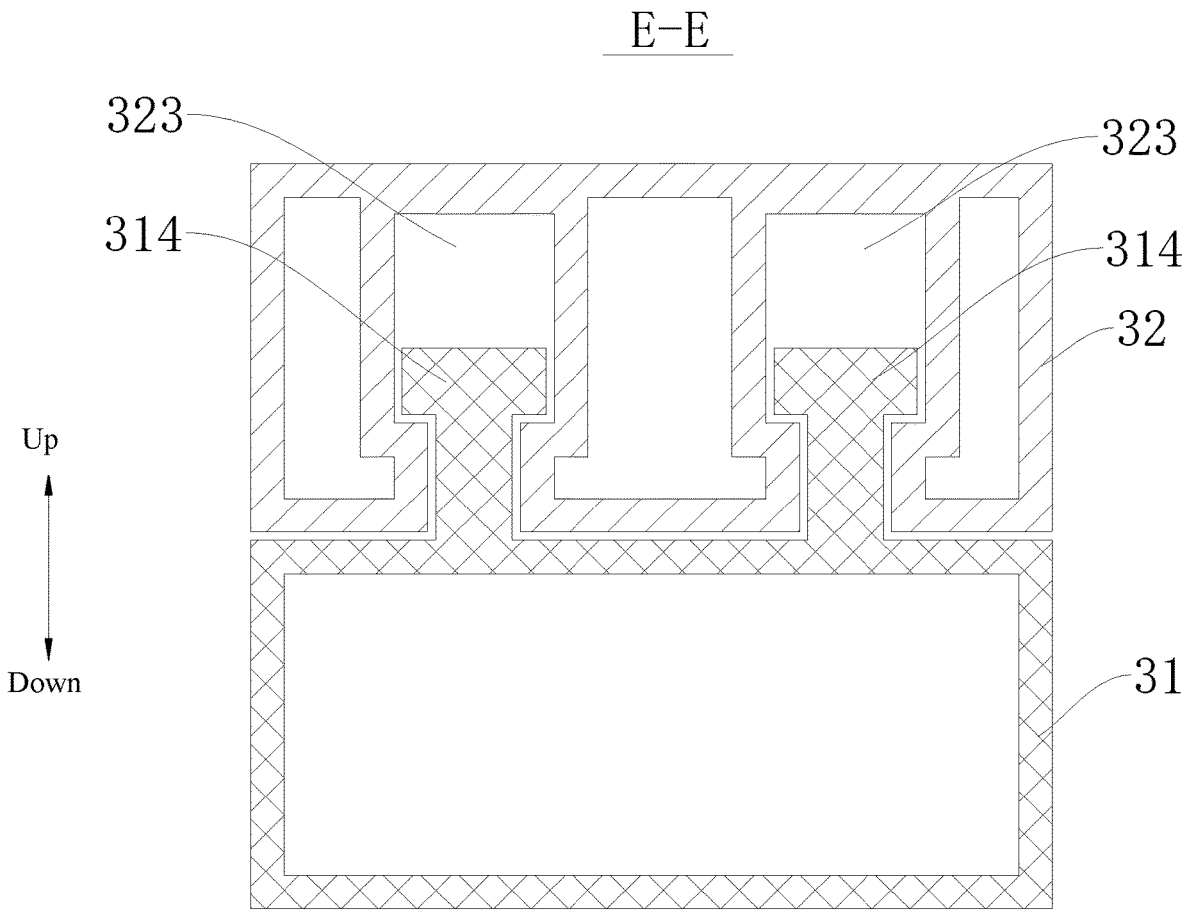
FIG. 21 is a sectional view along a line E-E in FIG. 20.

As illustrated in FIGS. 20-21, according to some embodiments of the present disclosure, one of the fixing member 31 and the sliding member 32 is provided with a slide rail 314, and the other one of the fixing member 31 and the sliding member 32 has a sliding groove 323 slidably fitted with the slide rail 314. That is, the slide rail 314 may be provided to the fixing member 31, and the sliding groove 323 may be provided in the sliding member 32. Or, the sliding groove 323 may be provided in the fixing member 31, and the slide rail 314 may be provided to the sliding member 32. The slide rail 314 may be slidably fitted with the sliding groove 323, such that the fixing member 31 is fitted with the sliding member 32 smoothly.

For example, as illustrated in FIG. 21, a part of an upper end of the fixing member 31 extends upwards to form two spaced slide rails 314, and a bottom of the sliding member 32 is provided with two spaced sliding grooves 323. When the sliding member 32 is assembled with the fixing member 31, each slide rail 314 may extend into the corresponding sliding member 323. When the sliding member 32 extends outwards, the slide rail 314 and the sliding groove 323 are slidably fitted with each other. Optionally, a lubricant oil may be added into the sliding groove 323 such that the slide rail 314 and the sliding groove 323 may be fitted with each other smoothly. Optionally, an adhesive layer may be provided on an end face of the sliding member 32 close to the mounting opening 201. In the second position, the sliding member 32 may be hermetically fitted with the inner wall of the mounting opening 201 by the adhesive layer, and hence the connection structure between the sealing device 30 and the mounting opening 201 is firm.

Figure 28:
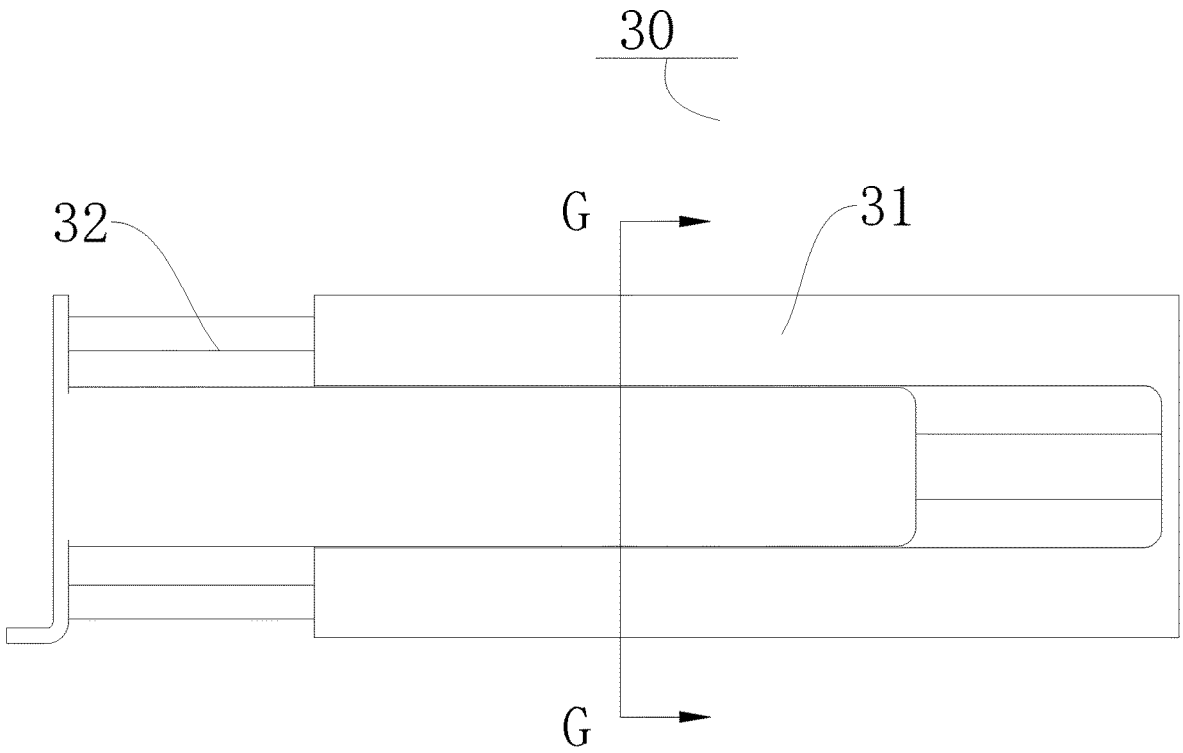
FIG. 28 is a front view of the sealing device in FIG. 25.
Figure 29:
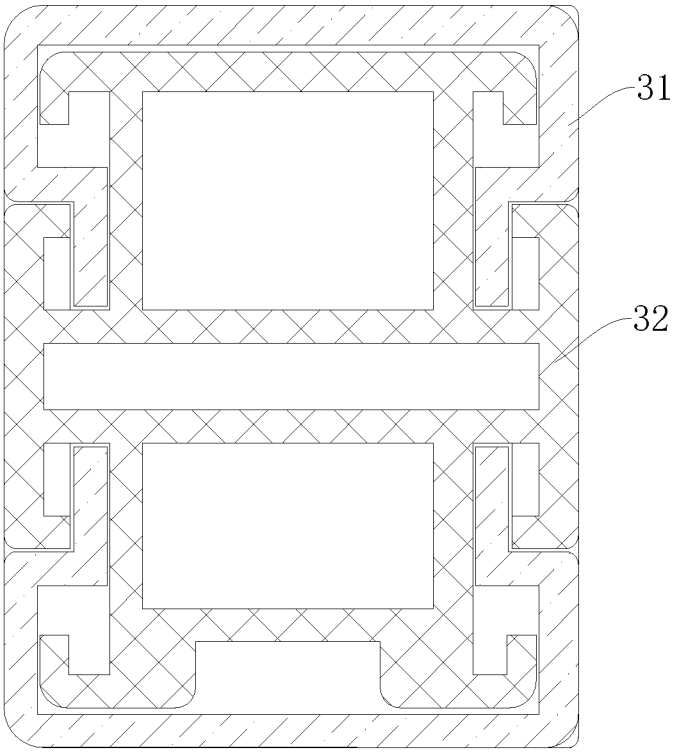
FIG. 29 is a sectional view along a line G-G in FIG. 28.

In the specific example illustrated in FIGS. 28-29, the fixing member 31 may be fitted with the sliding member 32 in a nested manner. The fixing member 31 may include a fit space for the sliding member 32, and the sliding member 32 may include a fit space for the fixing member 31. Thus, the fixing member 31 and the sliding member 32 are firmly fitted together. Through the above configurations, the fit structure of the fixing member 31 and the sliding member 32 is firm, so as to prevent the sliding member 32 from having a dislocation phenomenon during its sliding process.

As illustrated in FIG. 30, according to some embodiments of the present disclosure, the sealing device 30 is rotatable with respect to the casing 1, and the sealing device 30 may have a stretched state and a retracted state. In the retracted state, the sealing device 30 may be received in the receiving groove a, and in the stretched state, the sealing device 30 may be rotated and stretched out of the casing 1. Thus, the connection between the sealing device 30 and the casing 1 may be flexible and it is convenient to mount the sealing device 30. Specifically, when the window air conditioner 100 is in transit, the sealing device 30 may be in the retracted state, and the sealing device 30 may be received in the receiving groove a. Thereby, the occupied volume of the sealing device 30 is reduced. When the window air conditioner 100 is assembled in the mounting opening 201, the sealing device 30 may be adjusted to the stretched state, and the sealing device 30 may be stretched out with respect to the casing 1 and closely fitted with the inner wall of the mounting opening 201, thus providing a good sealing effect.

Figure 31:
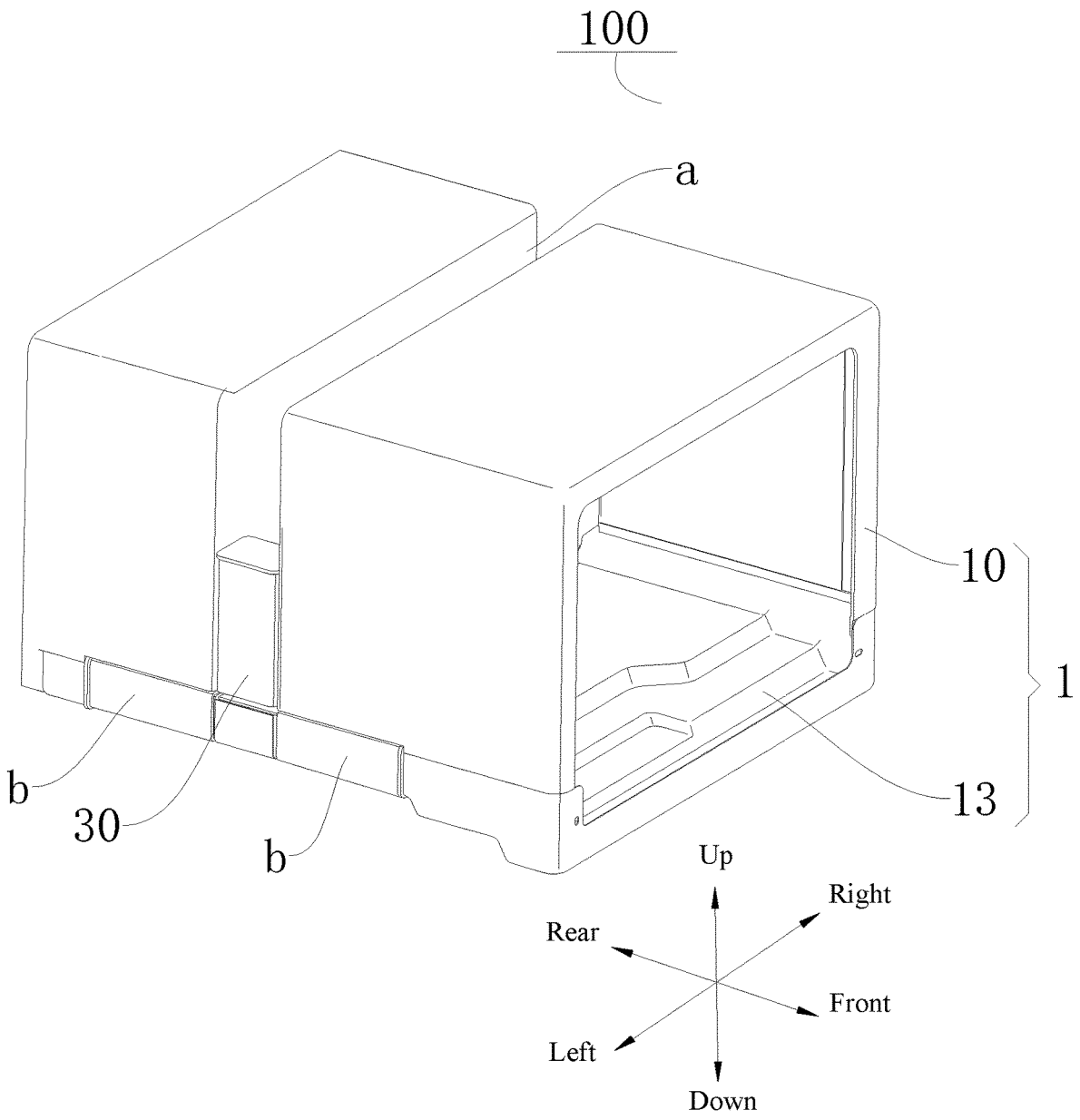
FIG. 31 is a schematic view of a window air conditioner according to some embodiments of the present disclosure, in which a sealing device is in a retracted state.

As illustrated in FIGS. 30 and 31, according to some embodiments of the present disclosure, the sealing device 30 is rotatable with respect to the casing 1, and the chassis 13 is provided with an accommodating groove b. The sealing device 30 has the stretched state and the retracted state. In the retracted state, the sealing device 30 is accommodated in the accommodating groove b, and in the stretched state, the sealing device 30 is rotated and stretched out of the casing 1. Thereby, the connection between the sealing device 30 and the casing 1 is flexible and it is convenient to mount the sealing device 30.

For example, as illustrated in FIGS. 30 and 31, two accommodating grooves b are provided in a side wall of chassis 13, and the two accommodating grooves b are spaced apart from each other by the receiving groove a of the casing 1. One of the accommodating grooves b is arranged in front of the receiving groove a, and the other accommodating groove b is arranged in rear of the receiving groove a. When the sealing device 30 is in the retracted state, the sealing device 30 may be accommodated in one of the accommodating grooves b, which may be selected and set according to the actual usage need.

In the following, the window air conditioner 100 of the present disclosure will be described in detail with reference to FIGS. 25-27 and 30-32 by means of a specific embodiment. The window air conditioner 100 may be used for adjusting an indoor air temperature and an indoor air humidity. It should be understood that the following descriptions are only exemplary, and cannot be construed as a limitation to the present disclosure.

As illustrated in FIG. 32, the wall 200 is provided with the rectangular mounting opening 201, the inner peripheral wall of the mounting opening 201 is provided with the window frame 301, the window 300 is arranged in the mounting opening 201 and may be moved up and down with respect to the mounting opening 201, and the window air conditioner 100 is mounted in the mounting opening 201.

As illustrated in FIGS. 30-31, the window air conditioner 100 includes the casing 1 and the sealing device 30. The casing 1 includes the cabinet 10 and the chassis 13. The outer peripheral wall of the cabinet 10 is provided with the receiving groove a recessed downwards, and the bottom wall of the receiving groove a is provided with a second sealing member made of silica gel materials. The side wall of the chassis 13 is provided with two accommodating grooves b, and the two accommodating grooves b are spaced apart from each other by the receiving groove a of the casing 1. One of the accommodating grooves b is arranged in front of the receiving groove a, and the other accommodating groove b is arranged in rear of the receiving groove a. The left end and the right end of the casing 1 each are provided with the sealing device 30, and the sealing device 30 is rotatably connected with the casing 1.

As illustrated in FIGS. 25-27, the sealing device 30 includes the fixing member 31 and the sliding member 32. The fixing member 31 is connected with the casing 1, and the sliding member 32 is slidably fitted with the fixing member 31. The fixing member 31 is provided with the positioning part 312, and the sliding member 32 is provided with the sliding guide rail 322 fitted with the positioning part 312. The sliding guide rail 322 has a plurality of positioning grooves 3221 spaced apart from one another along the length direction of the sliding guide rail 322.

As illustrated in FIG. 27, the positioning part 312 includes the connecting arm 3121 and the assembling protrusion 3122, the connecting arm 3121 is connected with the fixing member 31, and the assembling protrusion 3122 is connected with the connection arm 3121 and extends into the positioning groove 3221. The assembling protrusion 3122 has the first inclined surface 3122*a* and the second inclined surface 3122*b*. The included angle α between the first inclined surface 3122*a* and the horizontal plane is 120 degrees, and the included angle β between the second inclined surface 3122*b* and the horizontal plane is 90 degrees. The positioning groove 3221 has the third inclined surface 3221*a* and the fourth inclined surface 3221*b* arranged opposite to each other in the left and right direction. The third inclined surface 3221*a* is arranged parallel to the first inclined surface 3122*a*, and the fourth inclined surface 3221*b* is arranged parallel to the second inclined surface 3122*b*.

The positioning part 312 has the deformed state and the positioned state. When the positioning part 312 is in the positioned state, the assembling protrusion 3122 extends into the positioning groove 3221. When the sliding member 32 moves in the direction running away from the fixing member 31, the first inclined surface 3122*a* and the third inclined surface 3221*a* are slidably fitted with each other. When the sliding member 32 moves in the direction approaching the fixing member 31, the second inclined surface 3122*b* abuts against the fourth inclined surface 3221*b* to restrict the movement of the sliding member 32. When the positioning part 312 is in the deformed state, the connecting arm 3121 is elastically deformed, such that the assembling protrusion 3122 may be driven to be separated from the positioning groove 3221. In this case, the sliding member 32 may slide freely in the left and right direction.

The sealing device 30 has the stretched state and the retracted state. When the sealing device 30 is in the retracted state, the sealing device 30 may be received in the receiving groove a, or the sealing device 30 may also be accommodated in one of the accommodating grooves b. When the sealing device 30 is in the stretched state, first, the sealing device 30 rotates with respect to the casing 1 to a position where the sealing device 30 is parallel with the horizontal plane of the window frame 301, and then, the sliding member 32 slides outwards with respect to the fixing member 31 and is closely fitted with the inner wall of the window frame 301. The positioning part 312 allows the sliding member 32 to keep closely fitted with the window frame 301, thus providing a good sealing effect.

According to some embodiments of the present disclosure, as illustrated in FIGS. 31 and 32, the casing 1 may include the chassis 13, and the chassis 13 may be arranged at the bottom of the cabinet 10 and placed on the wall 200. The window air conditioner 100 also includes the sealing device 30.

As illustrated in FIG. 30-34, the connecting end 34 of the sealing device 30 may be rotatably connected with the casing 1. The sealing device 30 may have a retracted state and a sealed state. In the retracted state, the sealing device 30 may be received in the casing 1. In the sealed state, the sealing device 30 may extend out of the casing 1 and contact a lower end of the window 300, so as to seal the gap between the window 300 and the mounting opening 201.

Specifically, when the window air conditioner 100 is in transit, the sealing device 30 may be in the retracted state, and the sealing device 30 may be received in the casing 1, so as to reduce the occupied volume of the sealing device 30. When the window air conditioner 100 is assembled in the mounting opening 201, the sealing device 30 may be adjusted to the sealed state.

Optionally, as illustrated in FIG. 32, the inner wall of the mounting opening 201 may be provided with the window frame 301, and the chassis 13 may be arranged at the window frame 301, so as to improve the sealing effect between the mounting opening 201 and the window air conditioner 100. When the window air conditioner 100 is mounted, the window 300 may move downwards with respect to the wall 200 and extend into the receiving groove a. A left side wall and a right side wall of the window 300 may be closely fitted with the inner peripheral wall of the window frame 301, respectively. Thus, the sealing effect between the window 300 and the mounting opening 201 can be improved, and hence the cooling and heating efficiency of the window air conditioner 100 can be enhanced.

It may be understood that, due to a height difference between the bottom wall of the receiving groove a and the bottom wall of the mounting opening 201, after the window 300 is fitted with the window air conditioner 100, there is an assembling gap between the bottom wall of the window 300 and the bottom wall of the mounting opening 201, which thus leads to the cold air leakage of the window air conditioner 100 and affects the cooling and heating efficiency of the window air conditioner 100. The sealing device 30 may be fitted with the mounting opening 201 to seal the assembling gap between the window 300 and the mounting opening 201, so as to improve the cooling efficiency of the window air conditioner 100.

Specifically, the sealing device 30 may have the connecting end 34 and a sealing end 35, and the connecting end 34 of the sealing device 30 may rotate with respect to the casing 1. Thus, the sealing device 30 may switch between the sealed state and the retracted state. When the sealing device 30 is in the sealed state, the bottom wall of the sealing device 30 may be fitted with the bottom wall of the mounting opening 201 hermetically, and the sealing end 35 of the sealing device 30 may be closely fitted with the inner wall of the mounting opening 201, so as to seal the assembling gap between the window 300 and the mounting opening 201, thus preventing the cold air leakage of the window air conditioner 100.

Optionally, the sealing device 30 may be a non-metallic part, and the non-metallic part has advantages of light weight as well as easy mounting and dismounting. For example, the sealing device 30 may be made of non-metallic materials such as plastics, rubber and silica gel. Of course, the sealing device 30 may also be a metal part, and the metal part has advantages of a firm structure and a long service life. For example, the sealing device 30 may be a sheet-metal part.

Optionally, the sealing device 30 may have a detachable connection with the casing 1. The sealing device 30 may be configured to have different models. The different models of the sealing devices 30 may have different lengths and heights. Thus, an appropriate sealing device 30 may be selected according to a distance between the casing 1 and the mounting opening 201 and a height difference between a bottom wall of the receiving groove a and the inner wall of the mounting opening 201, so as to improve the applicability of the sealing device 30, thus resulting in a close fit structure between the sealing device 30 and the mounting opening 201 and hence providing a good sealing effect.

In the following, the window air conditioner 100 of the present disclosure will be described in detail with reference to FIGS. 32, 34 and 36 by means of a specific embodiment.

As illustrated in FIG. 32, the wall 200 is provided with a rectangular mounting opening 201, the inner peripheral wall of the mounting opening 201 is provided with a window frame 301, and the window 300 is arranged in the mounting opening 201 and may be moved up and down with respect to the mounting opening 201.

Figure 34:
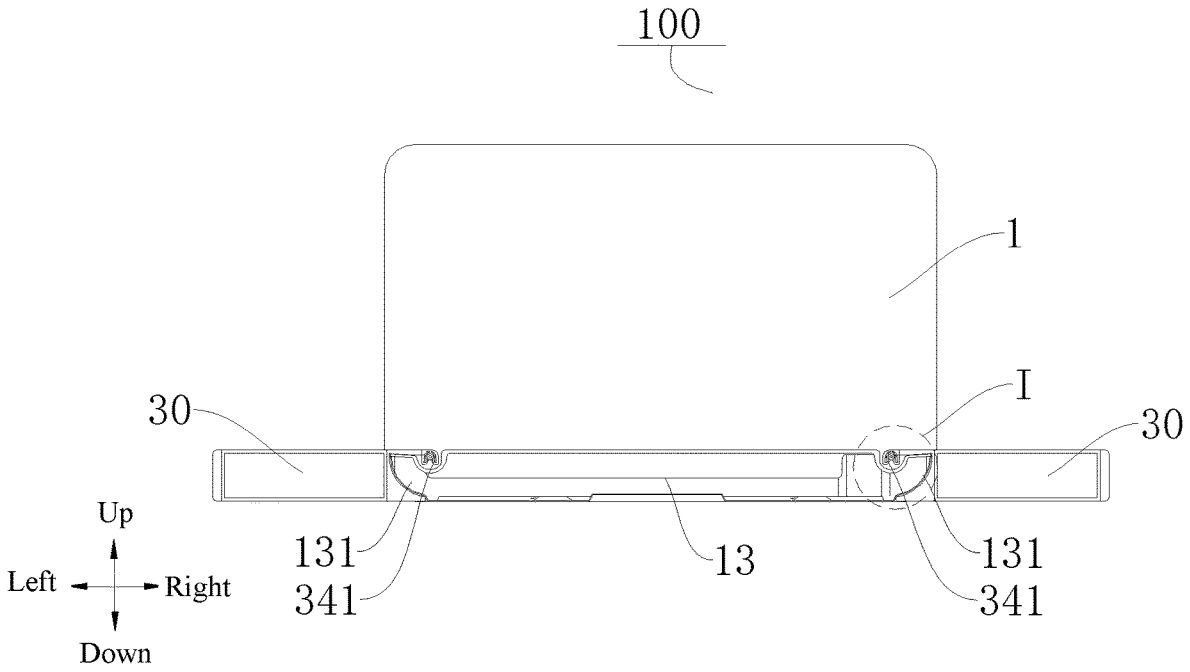
FIG. 34 is a schematic view of a window air conditioner according to some embodiments of the present disclosure, in which a sealing device is in a sealed state.
Figure 36:
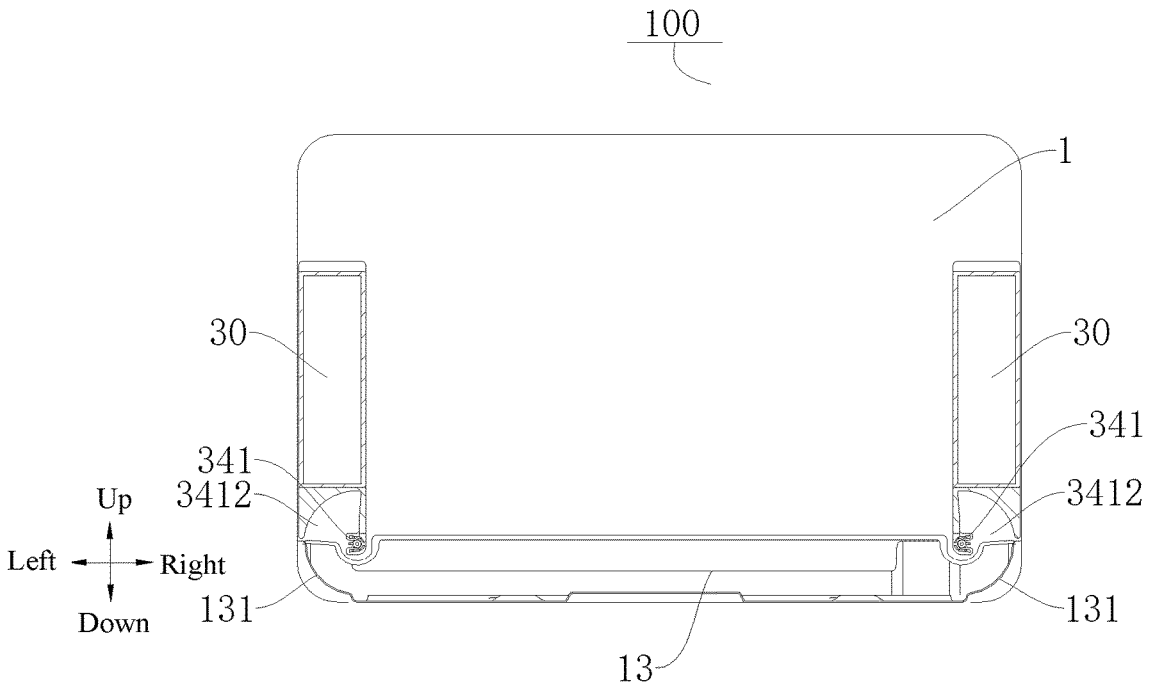
FIG. 36 is a schematic view of a window air conditioner according to some embodiments of the present disclosure, in which a sealing device is in a retracted state.

As illustrated in FIGS. 34 and 36, the window air conditioner 100 includes a casing 1 and a sealing device 30. The casing 1 includes a cabinet 10 and a chassis 13. The cabinet 10 is provided with a receiving groove a recessed downwards. The chassis 13 is disposed at the bottom of the cabinet 10 and arranged at the window frame 301. The left end and the right end of the cabinet 10 each are provided with the sealing device 30, and each sealing device 30 has a connecting end 34 and a sealing end 35. The connecting end 34 of the sealing device 30 is rotatably connected with the cabinet 10, and the sealing end 35 of the sealing device 30 may be fitted with the inner wall of the window frame 301. The sealing device 30 has a retracted state and a sealed state. When the window air conditioner 100 is in transit, the sealing device 30 may be in the retracted state, and the sealing device 30 may be received in the casing 1 so as to reduce the occupied volume of the sealing device 30. When the window air conditioner 100 is assembled in the mounting opening 201, first, the window 300 moves downwards and extends into the receiving groove a of the cabinet 10, and then, the sealing device 30 is adjusted from the retracted state to the sealed state. The connecting end 34 of the sealing device 30 rotates with respect to the casing 1 to make the bottom wall and the side wall of the sealing device 30 closely fitted with the inner peripheral wall of the window frame 301, respectively. Thus, a sealed fit between the window air conditioner 100 and the mounting opening 201 can be realized, and the cold air leakage of the window air conditioner 100 can be prevented, so that the cooling and heating efficiency of the window air conditioner 100 can be improved.

It should be noted that an arrangement manner of the sealing device 30 is not limited to this, but may be selected and set according to the actual mounting situation. For example, the sealing device 30 may be provided only on one side of the casing 1 along the width direction (i.e. the left and right direction as illustrated in FIG. 32), and the other side of the casing 1 along the width direction may be closely fitted with the inner wall of the mounting opening 201. Thus, the sealed fit between the window air conditioner 100 and the mounting opening 201 may also be realized.

In the window air conditioner 100 according to embodiments of the present disclosure, by providing the sealing device 30 rotatable with respect to the casing 1, the sealing device 30 may be fitted with the mounting opening 201 to seal the assembling gap between the window 300 and the mounting opening 201, so as to improve the sealing effect of the window air conditioner 100 and enhance the cooling and heating efficiency of the window air conditioner 100. The window air conditioner 100 has a convenient operation and a good sealing performance, and also is suitable for different types of mounting openings 201, thus providing a strong practicability.

In the following, the sealing device 30 according to some embodiments of the present disclosure will be described with reference to FIGS. 33-40.

As illustrated in FIGS. 33-36, according to some embodiments of the present disclosure, the casing 1 may be provided with an engaging shaft 103, and the connecting end 34 of the sealing device 30 may be provided with a hook 341. The hook 341 may be hooked on the engaging shaft 103, and the sealing device 30 may rotate with respect to the engaging shaft 103, such that the fit structure between the sealing device 30 and the casing 1 is simple and also is easy to operate. For example, as illustrated in FIGS. 34 and 36, one end of the engaging shaft 103 is rotatably connected with the casing 1, and the hook 341 is hooked on the engaging shaft 103. When the sealing device 30 rotates to a position where the sealing device 30 is perpendicular to the horizontal plane, the sealing device 30 is in the retracted state. In this case, the outer side wall of the sealing device 30 is flush with the outer side wall of the cabinet 10, and the sealing device 30 is received in the receiving groove a. Thus, the fit structure of the sealing device 30 and the cabinet 10 is compact. When the sealing device 30 rotates to a position where the sealing device 30 is parallel to the horizontal plane, the sealing device 30 is in the sealed state. In this case, the bottom wall and the left side wall of the sealing device 30 on the left side are closely fitted with the inner wall of the mounting opening 201, and the bottom wall and the right side wall of the sealing device 30 on the right side are closely fitted with the inner wall of the mounting opening 201.

Optionally, the hook 341 and the engaging shaft 103 may form a detachable connection structure together, so as to facilitate the maintenance and replacement of the sealing device 30, thus improving the usage flexibility for the user.

Figure 38:
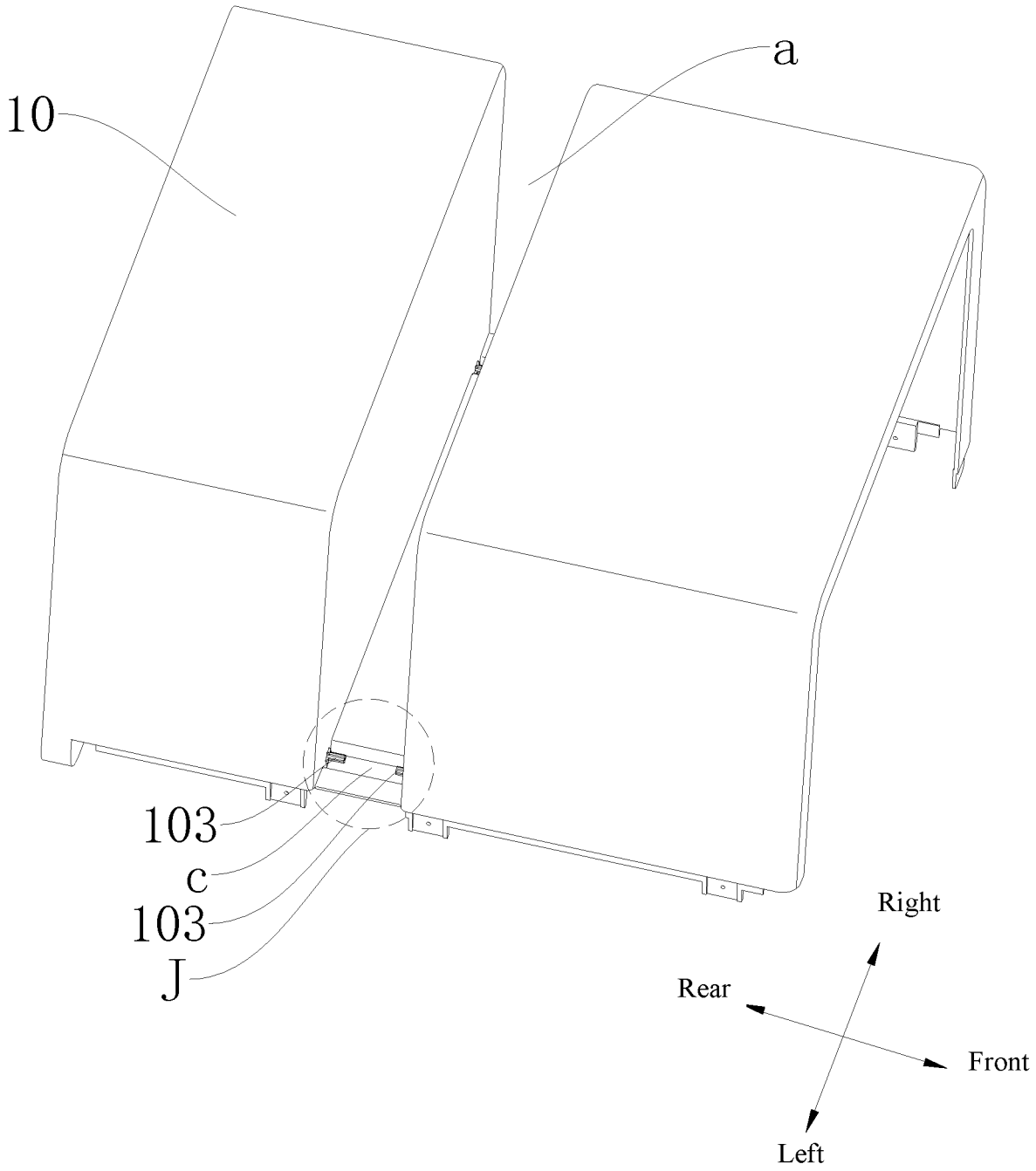
FIG. 38 is a schematic view of a cabinet according to some embodiments of the present disclosure.
Figure 39:
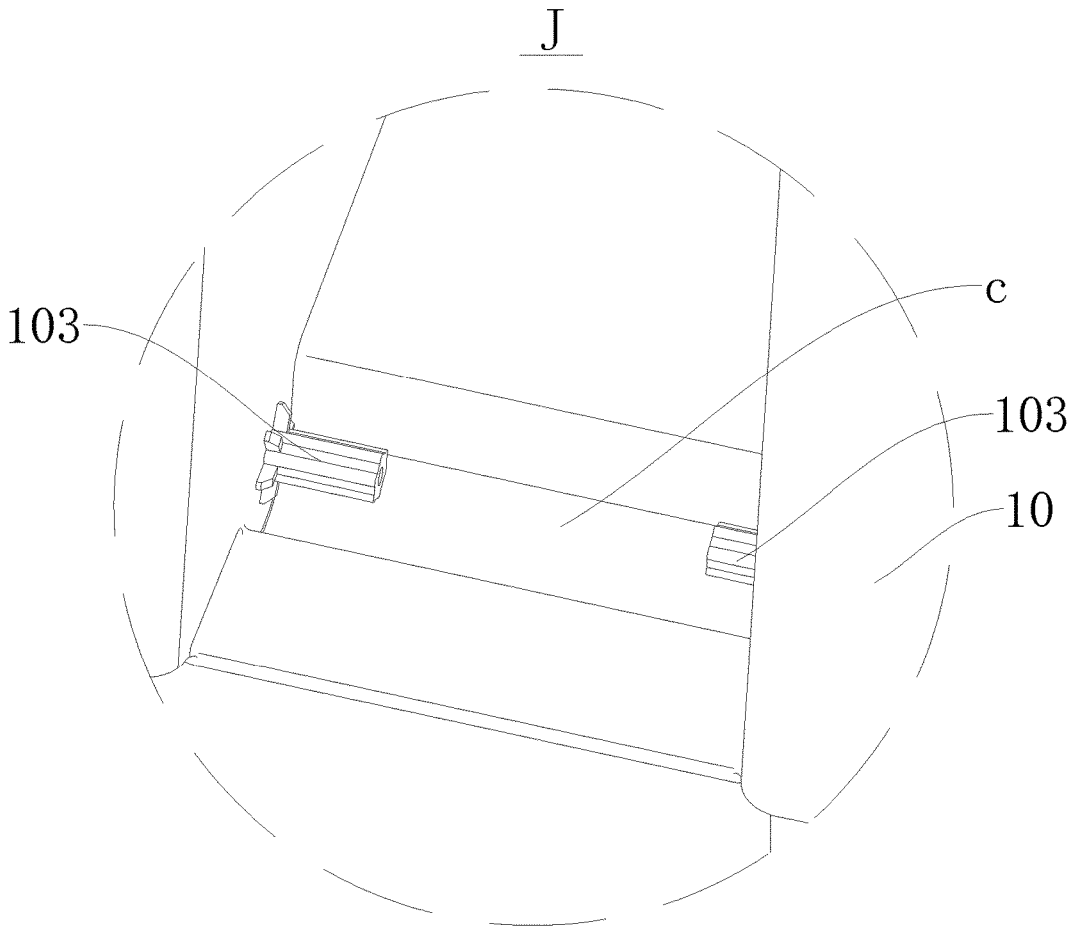
FIG. 39 is an enlarged view of a part J in FIG. 38.

As illustrated in FIGS. 38-39, in some embodiments of the present disclosure, the bottom wall of the receiving groove a may be provided with an assembling slot c recessed downwards, and the engaging shaft 103 may be arranged in the assembling slot c, such that the fit structure of the sealing device 30 and the receiving groove a is compact. Specifically, the assembling slot c may include a receiving space and a rotating space for the hook 341. When the sealing device 30 is engaged with the casing 1, the hook 341 may be hooked on the engaging shaft 103, and rotate in the assembling slot c, so as to ensure the smooth rotation of the hook 341.

Optionally, the sealing device 30 may be provided with two hooks 341, and the two hooks 341 may be arranged and spaced apart from each other along a width direction of the sealing device 30. Two engaging shafts 103 may be arranged in the assembling slot c, and the two hooks 341 may be hooked on the corresponding engaging shafts 103, respectively, so as to make the connection structure between the sealing device 30 and the casing 1 firm.

Figure 35:
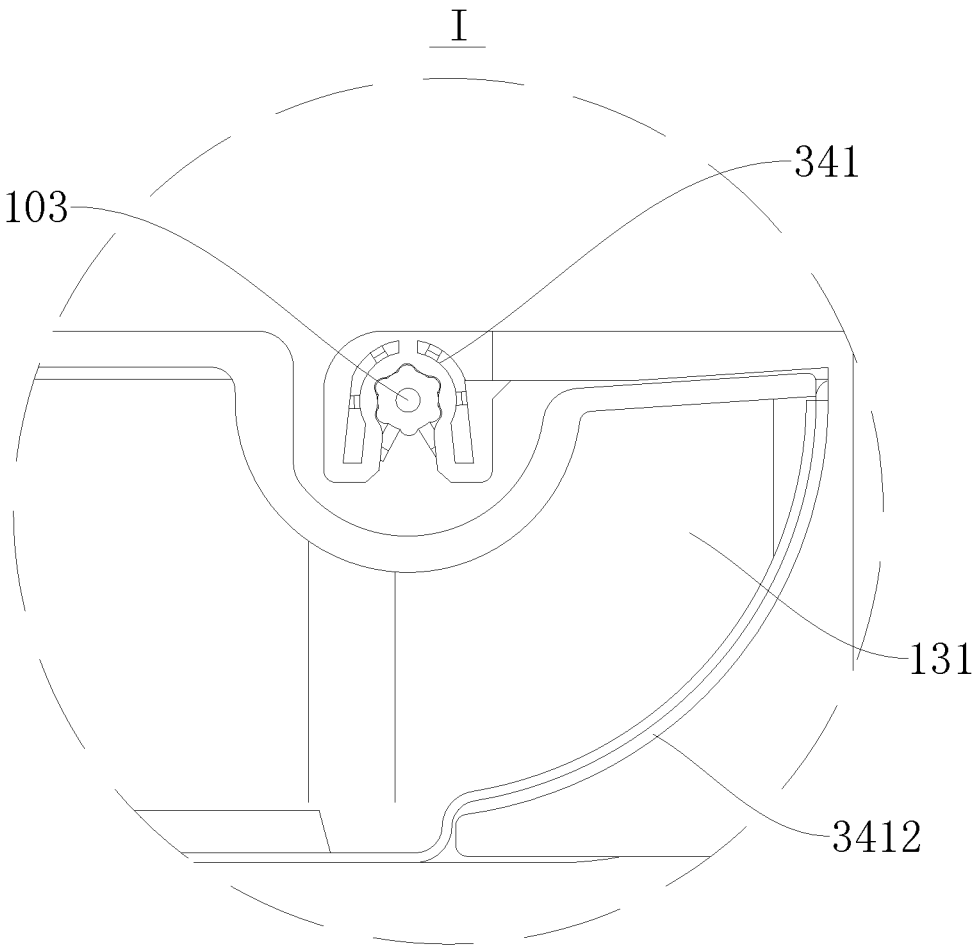
FIG. 35 is an enlarged view of a part I in FIG. 34.
Figure 40:
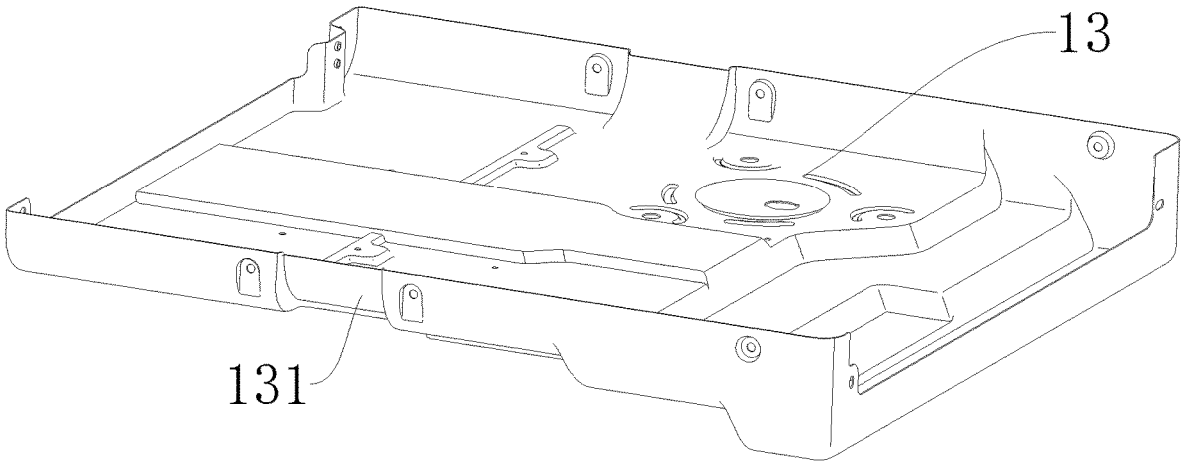
FIG. 40 is a schematic view of a chassis according to some embodiments of the present disclosure.

As illustrated in FIGS. 35, 36 and 40, in some embodiments of the present disclosure, the outer peripheral wall of the chassis 13 may be provided with a recessed part 131, and the connecting end 34 of the sealing device 30 may be provided with an assembling opening 3412. In the sealed state, a part of the chassis 13 may extend into the assembling opening 3412 such that an outer peripheral wall of the recessed part 131 is fitted with an inner peripheral wall of the assembling opening 3412. Thus, the fit structure between the sealing device 30 and the casing 1 is ingenious, and the normal rotation of the sealing device 30 with respect to the casing 1 is ensured.

For example, as illustrated in FIGS. 36 and 40, the recessed part 131 is formed in the bottom of the chassis 13, and the outer peripheral wall of the recessed part 131 has a circular arc shape. The connecting end 34 of the sealing device 30 is provided with the assembling opening 3412, and the inner wall of the assembling opening 3412 also has a circular arc shape. Thus, the assembling opening 3412 and the recessed part 131 form an arc-surface fit. When the sealing device 30 rotates with respect to the chassis 13, the assembling opening 3412 may slide with respect to the recessed part 131. As illustrated in FIG. 36, when the sealing device 30 is in the retracted state, the recessed part 131 is separated from the assembling opening 3412. As illustrated in FIG. 34, when the sealing device 30 is in the sealed state, the recessed part 131 is completely received in the assembling opening 3412.

Figure 37:
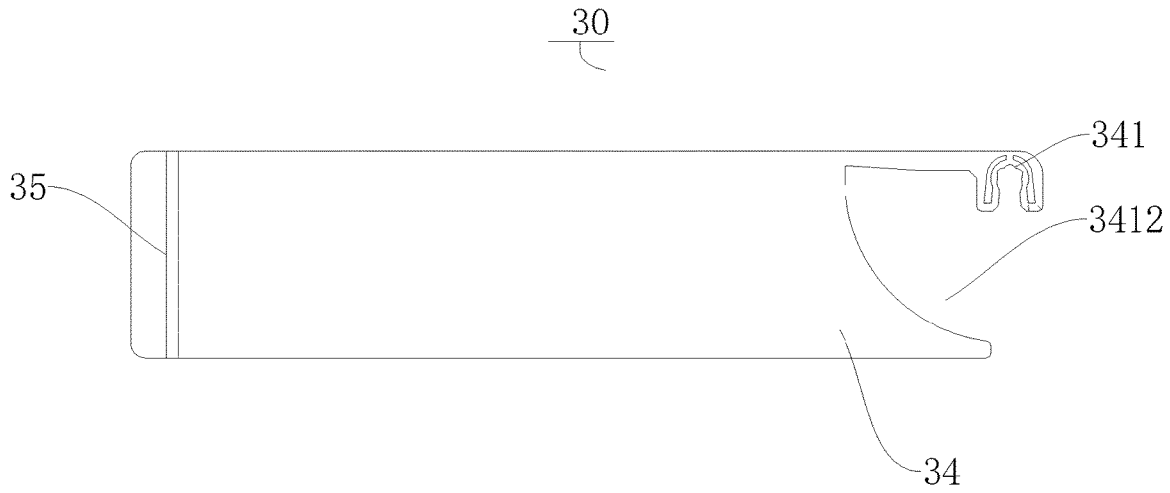
FIG. 37 is a schematic view of a sealing device according to some embodiments of the present disclosure.

As illustrated in FIG. 37, in a specific embodiment of the present disclosure, the sealing device 30 includes the connecting end 34 and the sealing end 35, the connecting end 34 is provided with the assembling opening 3412, and the inner peripheral wall of the assembling opening 3412 has a circular arc shape. An end of the sealing device 30 close to the assembling opening 3412 is provided with the hook 341. The sealing end 35 faces away from the connecting end 34, and the sealing end 35 is stretchable and retractable with respect to the connecting end 34. As illustrated in FIG. 40, the bottom wall of the chassis 13 is provided with the recessed part 131, and the outer peripheral wall of the recessed part 131 has a circular arc shape.

When the sealing device 30 is assembled with the casing 1, the hook 341 may be hooked on the engaging shaft 103. When the sealing device 30 rotates with respect to the chassis 13, the assembling opening 3412 may slide with respect to the recessed part 131. When the sealing device 30 is adjusted from the sealed state to the retracted state, first, the sealing end 35 retracts with respect to the connecting end 34. Then, the sealing device 30 rotates to a position where the sealing device 30 is perpendicular to the horizontal plane. The sealing device 30 is received in the receiving groove a, and the recessed part 131 is separated from the assembling opening 3412. When the sealing device 30 needs to be adjusted from the retracted state to the sealed state, first, the sealing device 30 rotates to a position where the sealing device 30 is parallel to the horizontal plane, and the recessed part 131 is completely received in the assembling opening 3412. Then, the sealing end 35 stretches outwards with respect to the connecting end 34. The bottom wall and the left side wall of the sealing device 30 on the left side are closely fitted with the inner wall of the mounting opening 201, and the bottom wall and the right side wall of the sealing device 30 on the right side are closely fitted with the inner wall of the mounting opening 201. Thus, a stretched length of the sealing end 35 may be adjusted according to the actual sizes of the mounting opening 201 and the window air conditioner 100, which is convenient to operate, and also improves the sealing effect of the sealing device 30.

In the following, the window air conditioner 100 according to some embodiments of the present disclosure will be described with reference to FIGS. 30 and 31.

As illustrated in FIG. 30, in some embodiments of the present disclosure, the side wall of chassis 13 may be provided with a plurality of accommodating grooves b. In the retracted state, the sealing device 30 may be accommodated in one of the accommodating grooves b, so as to improve the usage flexibility of the window air conditioner 100. For example, as illustrated in FIG. 31, there are two accommodating grooves b in the side wall of the chassis 13, and the two accommodating grooves b are spaced apart from each other by the receiving groove a of the casing 1. One of the accommodating grooves b is arranged in front of the receiving groove a, and the other accommodating groove b is arranged in rear of the receiving groove a. When the sealing device 30 is in the retracted state, the sealing device 30 may be received in the receiving groove a or in one of the accommodating grooves b, which may be selected and set according to the actual usage need.

As illustrated in FIG. 30, according to some embodiments of the present disclosure, the sealing device 30 may include a rotating part 36 and a sealing part 37, the rotating part 36 may be rotatably connected with the casing 1 rotation, and the sealing part 37 may be connected with the rotating part 36 and be stretchable and retractable with respect to the rotating part 36. In the retracted state, at least a part of the sealing part 37 may be received in the rotating part 36, and in the sealed state, the sealing part 37 may extend out of the rotating part 36 and be closely fitted with the inner wall of the mounting opening 201, so as to improve the applicability of the sealing device 30.

Specifically, when the sealing device 30 is adjusted from the sealed state to the retracted state, first, the sealing part 37 may be received in the rotating part 36, and then the sealing device 30 may be rotated into the casing 1. When the sealing device 30 is adjusted from the retracted state to the sealed state, first, the sealing part 37 may be drawn out of the rotating part 36, and then the sealing device 30 may be rotated to a position where the sealing device 30 is closely fitted with the inner wall of the mounting opening 201. Of course, the sealing device 30 may also be first rotated to the position where the sealing device 30 is closely fitted with the inner wall of the mounting opening 201, and then the sealing part 37 may be drawn out from the rotating part 36.

Optionally, a plurality of the sealing parts 37 may be provided, the plurality of the sealing parts 37 may be connected in sequence along a length direction of the rotating part 36, and adjacent two sealing parts 37 are movable with respect to each other. Thus, the applicability range of the sealing device 30 is expanded. It may be understood that, when all the plurality of the sealing parts are drawn out of the rotating part 36, the sealing device 30 has a maximum length, and when all the plurality of the sealing parts 37 are received in the rotating part 36, the sealing device 30 has a minimum length. By providing the plurality of the sealing parts 37, a length adjustment range of the sealing device 30 can be expanded, so that the sealing device 30 may be suitable for different types of mounting openings 201 and window air conditioners 100.

Optionally, the sealing part 37 and the rotating part 36 both may be configured as hollow parts, and heat insulation materials may be filled in the sealing part 37 and the rotating part 36, so as to improve the insulation effect of the sealing device 30 and further improve the cooling and heating efficiency of the window air conditioner 100.

As illustrated in FIG. 30, in some embodiments of the present disclosure, an end face of the sealing part 37 close to the mounting opening 201 may be provided with an adhesive layer 371. In the sealed state, the sealing part 37 may be hermetically fitted with the inner wall of the mounting opening 201 through the adhesive layer 371, so as to make the connection structure between the sealing device 30 and the mounting opening 201 firm. Of course, it may be understood that a fixing manner of the sealing device 30 is not unique. For example, when the sealing device 30 is in the sealed state, the sealing device 30 may be connected with the inner wall of the mounting opening 201 by means of screw connection.

According to some embodiments of the present disclosure, an outer surface of the sealing device 30 may be provided with a flexible first sealing member, and a part of the bottom wall of the window 300 may abut against the first sealing member, so as to improve the sealing effect between the window 300 and the window air conditioner 100. Specifically, when the window air conditioner 100 is mounted, the window 300 may be moved up and down, and the part of the bottom wall of the window 300 may abut against a top surface of the sealing device 30. Since the first sealing member is a flexible part, the first sealing member arranged at the top surface of the sealing device 30 may be closely fitted with the bottom wall of the window 300, and the first sealing member arranged at a bottom surface of the sealing device 30 allows a close connection between the sealing device 30 and the inner wall of the mounting opening 201, so that the fit among the window 300, the sealing device 30 and the mounting opening 201 is close.

Optionally, the first sealing member may be made of soft materials such as sponge, silica gel or rubber. Optionally, the first sealing member may be arranged only at the top surface of the sealing device 30, or only at the bottom surface of the sealing device 30, or to the top surface and the bottom surface of the sealing device 30 at the same time, which may be selected and set according to the actual usage need, and is not limited herein.

Optionally, the first sealing member may be connected to the sealing device 30 by means of adhering and fixing through adhesives. Or, the first sealing member may also be connected with the sealing device 30 by means of a positioning-pin connection. For example, a plurality of positioning pins may be provided to a bottom of the first sealing member, and a plurality of mounting holes may be formed in the top surface of the sealing device 30. When the first sealing member is assembled with the sealing device 30, each positioning pin may be inserted into the corresponding mounting hole. Then, the first sealing member is fixed to the sealing device 30.

According to some embodiments of the present disclosure, a flexible second sealing member may be provided to an inner wall of the receiving groove a, and a part of the bottom wall of the window 300 may abut against the second sealing member, so as to improve the sealing effect of the window air conditioner 100. Specifically, when the window air conditioner 100 is mounted, the window 300 may be moved downwards, and the part of the bottom wall of the window 300 may abut against the bottom wall of the receiving groove a. Since the second sealing member may be a flexible part, the second sealing member may be hermetically fitted with the bottom wall of the window 300, which allows a close fit between the window 300 and the inner wall of the receiving groove a.

Optionally, the second sealing member may be made of soft materials such as sponge, silica gel, or rubber. Optionally, the second sealing member may be connected with the inner wall of the receiving groove a by means of adhering and fixing through adhesives. Or, the second sealing member may also be connected with the inner wall of the receiving groove a by means of a positioning-pin connection. For example, the second sealing member may be a silicone sheet, and a layer of glue may be coated on a bottom of the second sealing member, such that the second sealing member may be connected with the inner wall of the receiving groove a by means of adhering and fixing.

In the following, the window air conditioner 100 according to a specific embodiment of the present disclosure will be descried in detail with reference to FIGS. 32-40. The window air conditioner 100 is used for adjusting an indoor air temperature and an indoor air humidity. It may be understood that the following descriptions are only exemplary, and cannot be construed as a limitation to the present disclosure.

As illustrated in FIG. 32, the wall 200 is provided with a rectangular mounting opening 201, an inner peripheral wall of the mounting opening 201 is provided with a window frame 301, the window 300 is arranged in the mounting opening 201 and may be moved up and down with respect to the mounting opening 201, and the window air conditioner 100 is mounted in the mounting opening 201.

As illustrated in FIGS. 33-34, 38 and 40, the window air conditioner 100 includes a casing 1 and a sealing device 30. The casing 1 includes a cabinet 10 and a chassis 13, the cabinet 10 is provided with a receiving groove a recessed downwards, and a bottom wall of the receiving groove a is provided with a second sealing member made of silica gel materials. As illustrated in FIGS. 38-39, the bottom wall of the receiving groove a may be provided with an assembling slot c recessed downwards, and two engaging shafts 103 are arranged in the assembling slot c and opposite to each other along a front and rear direction. As illustrated in FIG. 40, the chassis 13 is arranged at the bottom of the casing 1, a part of the bottom wall of the chassis 13, which is opposite to the assembling slot c, is provided with a recessed part 131, and an outer peripheral wall of the recessed part 131 has a circular arc shape.

Figure 33:
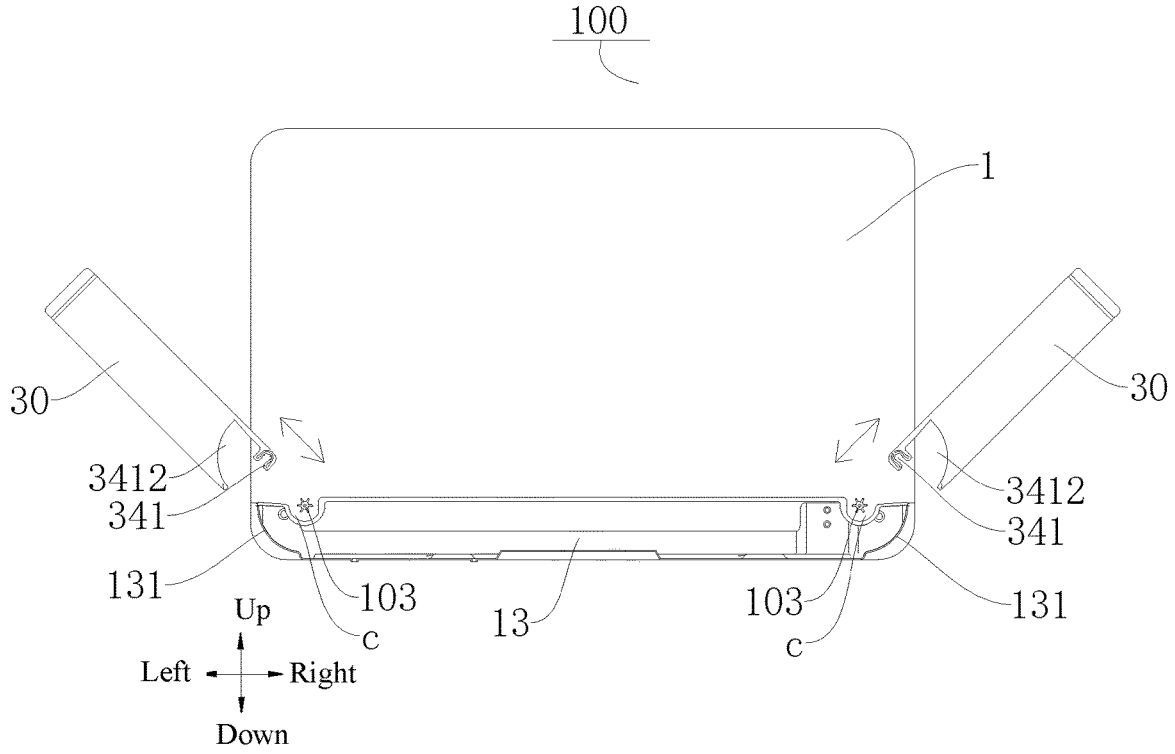
FIG. 33 is a schematic view of a window air conditioner according to some embodiments of the present disclosure.

As illustrated in FIGS. 33 and 37, the sealing device 30 is made of rubber materials. The sealing device 30 includes a connecting end 34 and a sealing end 35. The connecting end 34 is provided with an assembling opening 3412, and an inner peripheral wall of the assembling opening 3412 has a circular arc shape. An end of the sealing device 30 close to the assembling opening 3412 is provided with two hooks 341 spaced apart from each other. The sealing end 35 faces away from the connecting end 34, and the sealing end 35 is stretchable and retractable with respect to the connecting end 34.

As illustrated in FIGS. 33 and 37, the sealing device 100 is made of rubber materials. The sealing device 30 includes a connecting end 34 and a sealing end 35. The connecting end 34 is provided with an assembling opening 3412, and an inner peripheral wall of the assembling opening 3412 has a circular arc shape. An end of the sealing device 30 close to the assembling opening 3412 is provided with two hooks 341 spaced apart from each other. The sealing end 35 faces away from the connecting end 34, and the sealing end 35 is stretchable and retractable with respect to the connecting end 34.

When the sealing device 30 and the casing 1 are assembled, the two hooks 341 may be hooked on the corresponding engaging shaft 103, respectively, and a part of the recessed part 131 may extend into the assembling opening 3412. The sealing device 30 has a retracted state and a sealed state. When the sealing device 30 is adjusted from the sealed state to the retracted state, first, the sealing end 35 retracts with respect to the connecting end 34. Then, the sealing device 30 rotates to a position where the sealing device 30 is perpendicular to a horizontal plane of the window frame 301, and the sealing device 30 is received in the receiving groove a. When the sealing device 30 is adjusted from the retracted state to the sealed state, first, the sealing device 30 rotates to a position where the sealing device 30 is parallel to the horizontal plane of the window frame 301, and the recessed part 131 is completely received in the assembling opening 3412. Then, the sealing end 35 stretches outwards with respect to the connecting end 34 and abuts against the inner wall of the window frame 301. In this case, the bottom wall and the left side wall of the sealing device 30 one the left side are closely fitted with the inner peripheral wall of the window frame 301, respectively, and the bottom wall and the right side wall of the sealing device 30 on the right side are closely fitted with the inner peripheral wall of the window frame 301, respectively.

A stretched length of the sealing end 35 may be adjusted according to a distance between the casing 1 and the window frame 301, so that the sealing device 30 may be suitable for different types of mounting openings 201 and window air conditioners 100, thus improving the applicability of the sealing device 30.

Other components and operations of the window air conditioner 100 according to embodiments of the present disclosure are generally known by those skilled in the art and thus will not be described in detail herein.

Reference throughout this specification to terms "an embodiment," "some embodiments," "an example," "a specific example," or "some examples," means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Moreover, the particular features, structures, materials, or characteristics described may be combined in any suitable manner in one or more embodiments or examples.

Although embodiments of the present disclosure have been illustrated and described above, it should be understood by those skilled in the art that changes, modifications, alternatives, and variations can be made in the embodiments without departing from spirit, principles and scope of the present disclosure. The scope of the invention is defined by the claims and their equivalents.

The invention claimed is:

1. A window air conditioner comprising:

a casing comprising a cabinet, the cabinet comprising an outdoor part and an indoor part spaced apart from each other to form a receiving groove; and a positioning device having a locked state and an unlocked state, and being configured to extend further into the receiving groove in the locked state than in the unlocked state, the positioning device including:

a positioning member, a first end of the positioning member being arranged at the indoor part, and a second end of the positioning member extending towards the receiving groove with respect to the indoor part and being movable with respect to the indoor part;

a mounting shaft arranged at the indoor part;

an abutting protrusion arranged at an end of the mounting shaft that faces towards the receiving groove;

an elastic member sleeved over the mounting shaft; and a connecting plate connected with the positioning member, the connecting plate being sleeved over the mounting shaft and sandwiched between the elastic member and the abutting protrusion;

wherein the elastic member abuts against the connecting plate and is configured to drive the connecting plate to move along the mounting shaft towards the abutting protrusion.

2. The window air conditioner according to claim 1, wherein the positioning device is arranged at a side wall of the indoor part facing the outdoor part.

3. The window air conditioner according to claim 1, further comprising:

a sealing device;

wherein:

the casing further comprises a chassis disposed at a bottom of the cabinet; and the sealing device comprises:

a fixing member connected with the casing; and a sliding member slidably fitted with the fixing member and configured to slide between a first position at which the sliding member overlaps the fixing member and a second position at which the sliding member extends out of the fixing member.

4. The window air conditioner according to claim 3, wherein:

one of the fixing member and the sliding member includes a positioning part, and another one of the fixing member and the sliding member includes a sliding guide rail fitted with the positioning part, the sliding guide rail including a plurality of positioning grooves spaced apart from one another along a length direction of the sliding guide rail;

the positioning part has:

a positioned state in which at least a part of the positioning part extends into one of the positioning grooves to restrict a degree of freedom of movement of the sliding member in the length direction of the sliding guide rail, and a deformed state in which the positioning part is separated from the positioning grooves.

5. The window air conditioner according to claim 4, wherein:

the positioning part has a first surface and a second surface, an included angle between the first surface and a reference plane parallel to an extending direction of the sliding guide rail is larger than 90 degrees, and an included angle between the second surface and the reference plane is equal to 90 degrees;

each of the positioning grooves has a third surface and a fourth surface, the third surface is parallel to the first surface and is configured to slide on the first surface when the sliding member slides in a direction away from the fixing member, and the fourth surface is parallel to the second surface and is configured to abut against the second surface to restrict the movement of the sliding member when the sliding member is pushed in a direction towards the fixing member.

6. The window air conditioner according to claim 4, wherein the one of the fixing member and the sliding member includes an assembling groove, and the positioning part is arranged in the assembling groove.

7. The window air conditioner according to claim 4, wherein the positioning part has elasticity.

8. The window air conditioner according to claim 3, wherein the sealing device is rotatable with respect to the casing and has:

a retracted state in which the sealing device is received in the receiving groove, and a stretched state in which the sealing device rotates and extends out of the casing.

9. The window air conditioner according to claim 8, wherein:

the chassis includes an accommodating groove.

10. The window air conditioner according to claim 1, further comprising:

a sealing device, a connecting end of the sealing device being rotatably connected with the casing, and the sealing device having:

a retracted state in which the sealing device is received in the casing, and a sealed state in which the sealing device extends out of the casing.

11. The window air conditioner according to claim 10, wherein the casing includes an engaging shaft, the connecting end of the sealing device includes a hook configured to be hooked on the engaging shaft, and the sealing device is rotatable with respect to the engaging shaft.

12. The window air conditioner according to claim 11, wherein a bottom wall of the receiving groove includes an assembling slot recessed downwards, and the engaging shaft is arranged in the assembling slot.

13. The window air conditioner according to claim 11, wherein:

the casing further includes a chassis disposed at a bottom of the cabinet;

an outer peripheral wall of the chassis includes a recessed part, and the connecting end of the sealing device includes an assembling opening; and a part of the chassis is configured to extend into the assembling opening when the sealing device is in the sealed state such that an outer peripheral wall of the recessed part is fitted with an inner peripheral wall of the assembling opening.

14. The window air conditioner according to claim 10, wherein the sealing device comprising:

a rotating part rotatably connected with the casing; and a sealing part connected with the rotating part, and being stretchable and retractable with respect to the rotating part, the sealing part being configured to:

be at least partially received in the rotating part when the sealing device is in the retracted state, and extend out of the rotating part when the sealing device is in the sealed state.

15. A window air conditioner comprising:

a casing comprising a cabinet, the cabinet comprising an outdoor part and an indoor part spaced apart from each other to form a receiving groove; and a positioning device having a locked state and an unlocked state, and being configured to extend further into the receiving groove in the locked state than in the unlocked state, the positioning device including:

a rotating member including a sliding slot extending along a length direction of the rotating member, a first end of the rotating member being rotatably arranged at the indoor part through a rotating shaft; and a rotating drive member rotatably arranged at the indoor part through a pivot shaft different from the rotating shaft, the rotating drive member including a drive shaft extending into the sliding slot and movably fitted with the sliding slot, the drive shaft being spaced apart from the pivot shaft, and the rotating drive member being configured to rotate to drive a second end of the rotating member to rotate between the locked state and the unlocked state through the drive shaft.

16. A window air conditioner comprising:

a casing comprising a cabinet, the cabinet comprising an outdoor part and an indoor part spaced apart from each other to form a receiving groove; and a positioning device having a locked state and an unlocked state, and being configured to extend further into the receiving groove in the locked state than in the unlocked state, the positioning device including:

a cover including a first magnetic member, one end of the cover being rotatably arranged at the indoor part;

a second magnetic member arranged at the indoor part, the second magnetic member being configured to be powered on to attract the first magnetic member to control the cover to rotate to the unlocked state;

a position limiting structure arranged at the indoor part;

a support bar fixed to the cover, the support bar passing through the position limiting structure and being movable with respect to the position limiting structure; and an elastic member sleeved over the support bar, two ends of the elastic member abutting against the support bar and the position limiting structure, respectively, to normally push the cover to rotate to the locked state.

17. The window air conditioner according to claim 16, wherein the positioning device further comprises:

a battery box arranged in the indoor part and electrically connected with the second magnetic member; and a switch arranged at an outer side wall of the indoor part, the switch being electrically connected with the battery box to control power on and off of the second magnetic member.

* * * * *